US009764558B2

(12) United States Patent
Pourtier

(10) Patent No.: US 9,764,558 B2
(45) Date of Patent: Sep. 19, 2017

(54) METHOD AND DEVICE FOR REGULATING AN INK CIRCUIT PUMP

(71) Applicant: MARKEM-IMAJE HOLDING, Bourg-les-Valence (FR)

(72) Inventor: Francis Pourtier, Charmes sur Rhone (FR)

(73) Assignee: MARKEM IMAJE HOLDING, Bourg-les-Valence (FR)

( * ) Notice: Subject to any disclaimer, the term of this patent is extended or adjusted under 35 U.S.C. 154(b) by 0 days.

(21) Appl. No.: 14/780,844

(22) PCT Filed: Mar. 27, 2014

(86) PCT No.: PCT/EP2014/056218
§ 371 (c)(1),
(2) Date: Sep. 28, 2015

(87) PCT Pub. No.: WO2014/154833
PCT Pub. Date: Oct. 2, 2014

(65) Prior Publication Data

US 2016/0052291 A1 Feb. 25, 2016

(30) Foreign Application Priority Data

Mar. 29, 2013 (FR) ..... 13 52927

(51) Int. Cl.
*B41J 2/175* (2006.01)
*B41J 2/185* (2006.01)
(Continued)

(52) U.S. Cl.
CPC ..... *B41J 2/17596* (2013.01); *B41J 2/175* (2013.01); *B41J 2/185* (2013.01); *B41J 29/02* (2013.01); *B41J 29/13* (2013.01)

(58) Field of Classification Search
CPC . B41J 2/17596; B41J 2/175; B41J 2/18; B41J 2/03; B41J 2/17566; B41J 29/393;
(Continued)

(56) References Cited

U.S. PATENT DOCUMENTS 4,607,261 A 8/1986 McCann et al.
4,929,963 A 5/1990 Balazar
(Continued)

FOREIGN PATENT DOCUMENTS

CN 1553860 A 12/2004
CN 101219603 A 7/2008
(Continued)

OTHER PUBLICATIONS

French Preliminary Search Report dated Feb. 3, 2014 for related French Application No. 1352927.
(Continued)

*Primary Examiner* — Jannelle M Lebron
(74) *Attorney, Agent, or Firm* — Miles & Stockbridge P.C.

(57) ABSTRACT

A pumping circuit for fluid of an ink circuit in a continuous inkjet printer, including a diaphragm pump, an inlet circuit having an inlet conduit into the pump for the fluid to be pumped, an outlet conduit for the fluid pumped by the pump, the pumping circuit including a back-flow line which removes, from the outlet of the pump, part of the pumped fluid and returns it to the inlet circuit of fluid to be pumped, at least one singular restriction being arranged on the path of the fluid in the back-flow line, and the back-flow line regulating the pressure and the flow rate of the fluid at the outlet of the pump.

18 Claims, 13 Drawing Sheets

(51) Int. Cl.
*B41J 29/02* (2006.01)
*B41J 29/13* (2006.01)

(58) Field of Classification Search
CPC .... B41J 2/17523; B41J 2/17556; B41J 29/02; B41J 2/185
USPC ..... 347/85
See application file for complete search history.

(56) References Cited

U.S. PATENT DOCUMENTS

| | | | | |
|---|---|---|---|---|
| 9,102,157 | B2 | 8/2015 | Prothon et al. | |
| 2002/0057972 | A1 | 5/2002 | Barinaga et al. | |
| 2002/0101487 | A1 | 8/2002 | Petersen | |
| 2003/0128251 | A1 | 7/2003 | Ujita | |
| 2005/0057627 | A1 | 3/2005 | De Marco et al. | |
| 2006/0109321 | A1 | 5/2006 | Nottelman et al. | |
| 2008/0158273 | A1 | 7/2008 | Yoshikawa et al. | |
| 2008/0170099 | A1 | 7/2008 | Heo et al. | |
| 2009/0174735 | A1* | 7/2009 | Yamada | B41J 2/175 347/7 |
| 2010/0238243 | A1 | 9/2010 | Tomlin | |
| 2011/0025738 | A1 | 2/2011 | Rosati et al. | |
| 2011/0069125 | A1 | 3/2011 | Taga | |
| 2011/0267406 | A1* | 11/2011 | Hanson | B41J 2/17596 347/85 |
| 2012/0299989 | A1 | 11/2012 | Prothon | |
| 2016/0039216 | A1 | 2/2016 | Ribiero et al. | |

FOREIGN PATENT DOCUMENTS

| | | | |
|---|---|---|---|
| CN | 102026813 | A | 4/2011 |
| FR | 2 954 216 | A1 | 6/2011 |
| GB | 2 455 775 | A | 6/2009 |
| JP | 2003-220713 | A | 8/2003 |
| WO | 03/022586 | A2 | 3/2003 |
| WO | 03/097362 | A2 | 11/2003 |
| WO | 2007/129110 | A2 | 11/2007 |
| WO | 2009/049135 | A1 | 4/2009 |
| WO | 2010/118225 | A1 | 10/2010 |
| WO | 2011/076810 | A1 | 6/2011 |
| WO | 2012/066356 | A1 | 5/2012 |

OTHER PUBLICATIONS

International Search Report dated May 30, 2014 for related PCT Application No. PCT/EP/2014/056218.
Non-Final Office Action dated Aug. 11, 2016 for related U.S. Appl. No. 14/780,997.
French Preliminary Search Report dated Feb. 3, 2014 for related French Application No. 1352925.
International Search Report dated May 21, 2014 for related PCT Application No. PCT/EP2014/056215.
Office Action dated Jul. 14, 2016 for related Chinese patent application No. 201310751671.7.
Office Action dated Jul. 26, 2016 for related Chinese patent application No. 201310751311.7.
Office Action dated Jan. 26, 2017 for related Chinese Application No. 201310751671.7.

* cited by examiner

FIG.5
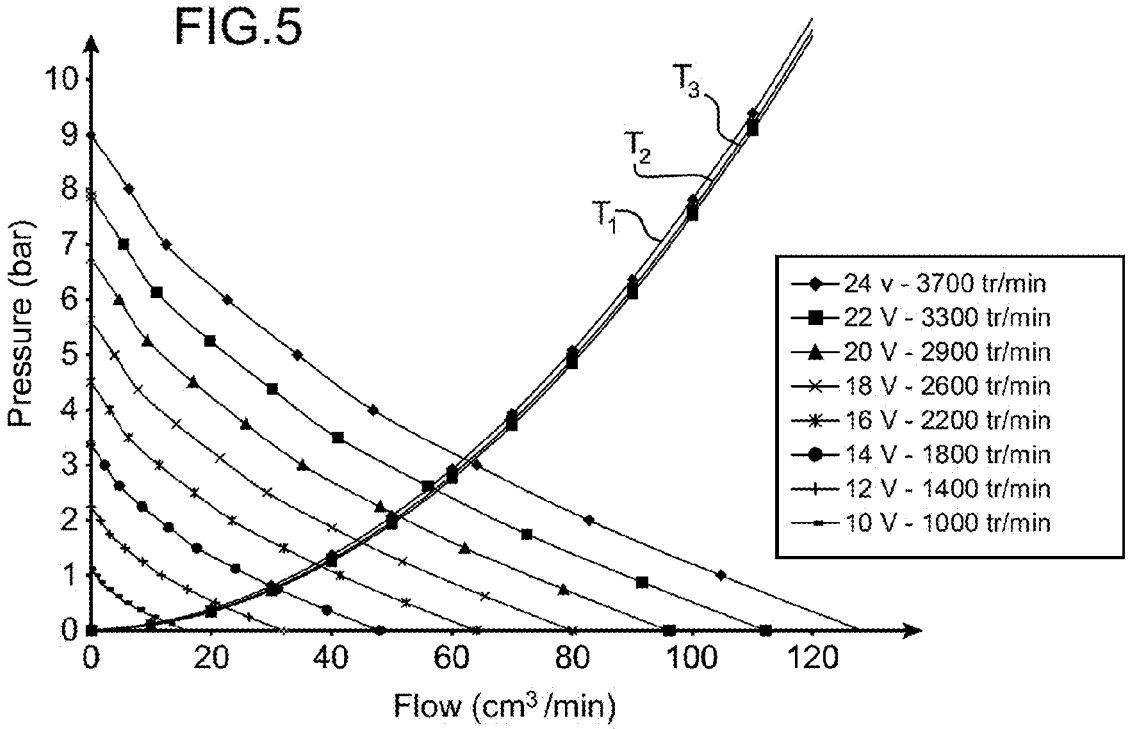
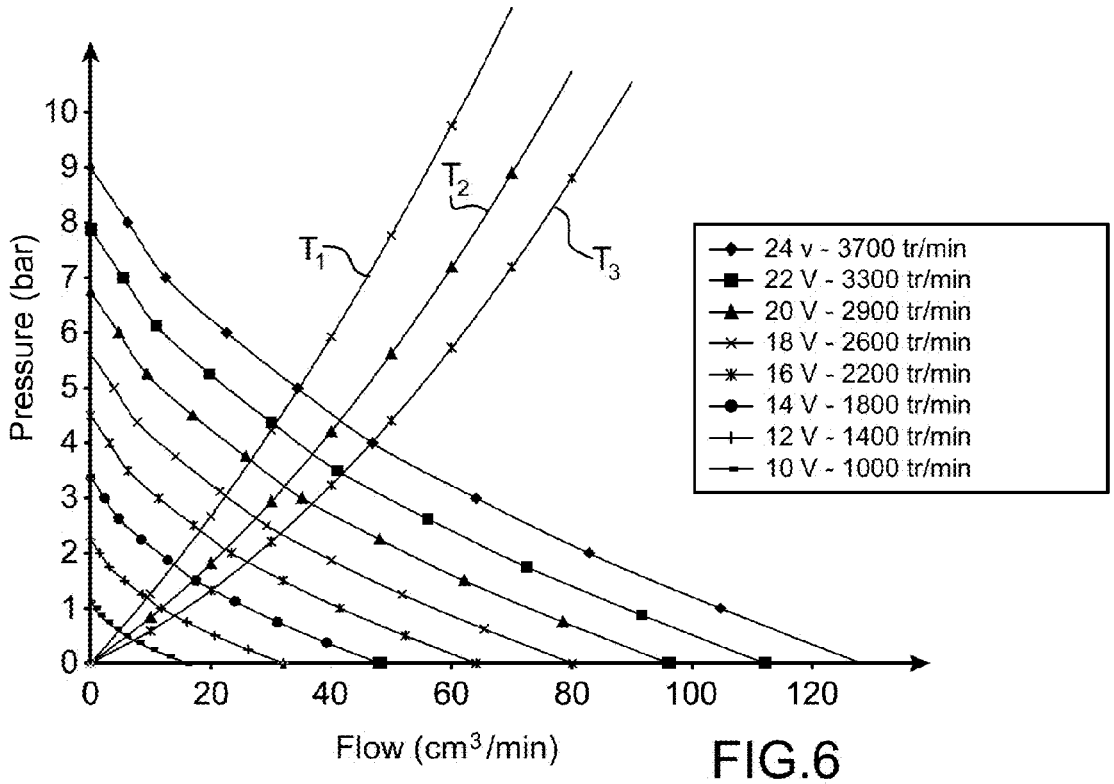
FIG.6

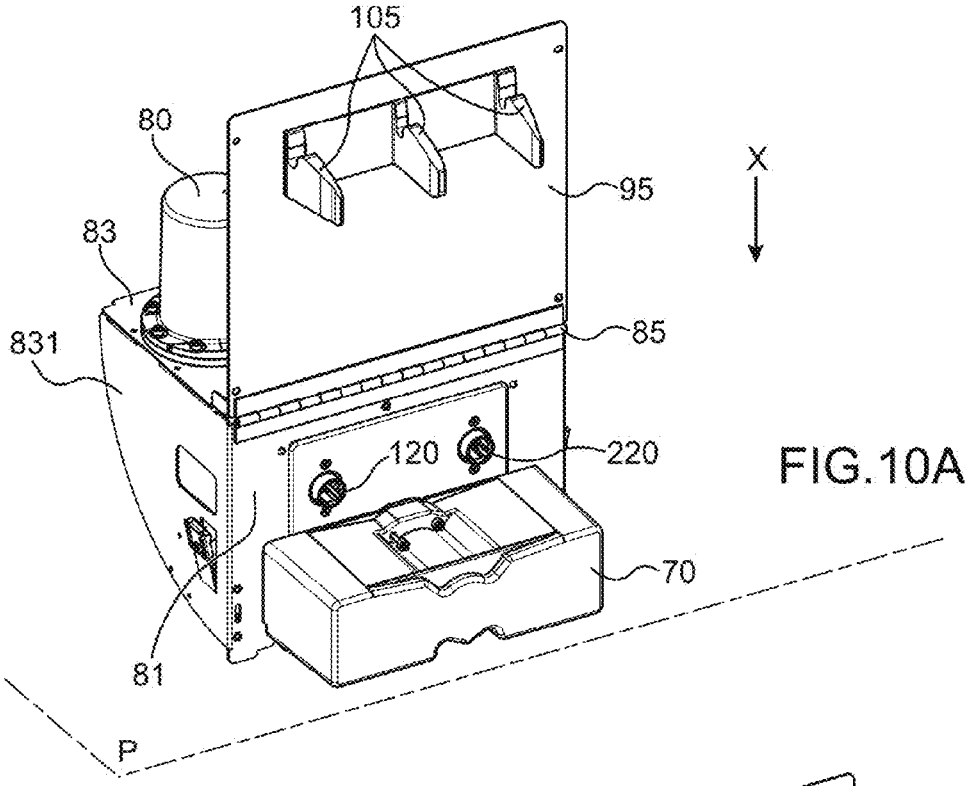
FIG.10A
FIG.10B
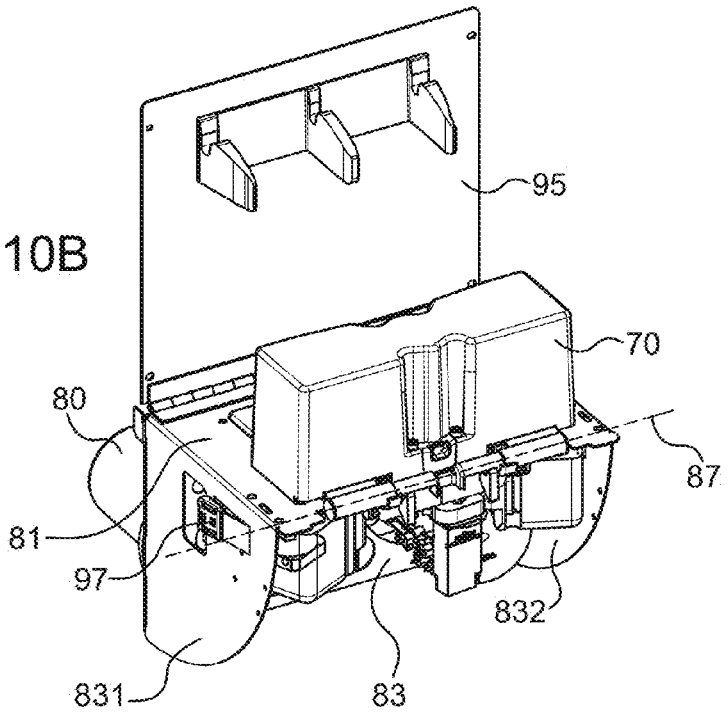

METHOD AND DEVICE FOR REGULATING AN INK CIRCUIT PUMP

The invention concerns the field of continuous inkjet printers (CIJ).

It also concerns the architecture (arrangement of the ink circuit) of CIJ printers, in particular for the purpose of minimizing the cost thereof.

It further concerns means for extending the operating scope of a diaphragm pump in relation to, or as a function of, temperature.

Continuous inkjet printers (CIJ) are well known in the field of industrial coding and labelling of various products, for example to mark barcodes or expiry dates on food items directly on the production line and at fast production rate. This type of printer is also found in some fields of design in which use is made of the graphic printing possibilities of the technology.

These printers contain several standard sub-assemblies as shown in FIG. 1.

First a print head 1, generally offset from the body of the printer 3, is connected thereto by a flexible umbilical cable 2 grouping together the hydraulic and electrical connections required for operation of the print head and imparting flexibility thereto which facilitates integration on the production line.

The body of the printer 3 (also called console or cabinet) usually contains three sub-assemblies:

- an ink circuit 4 in the lower part of the cabinet (zone 4') allowing firstly the supplying of ink to the head at stable pressure and of adequate quality, and secondly the taking in charge of the jetted ink that is not used for printing;
- a controller 5 located in the upper part of the cabinet (zone 5'), capable of managing the sequencing of actions and of conducting processing to permit the actuation of the different functions of the ink circuit and the head;
- an interface 6 which provides the operator with the means to set the printer in operation and to be informed of the functioning thereof.

In other words the body 3 comprises 2 sub-assemblies: at the top part the electronics, electrical supply and operator interface; and in the lower part an ink circuit supplying the head with ink of nominal quality and under pressure and providing a negative pressure for recovery of the ink not used by the head.

FIG. 2 schematically illustrates a print head 1 of a CIJ printer. It comprises a droplet generator 60 supplied with electrically conductive ink placed under pressure by the ink circuit 4.

This generator is capable of emitting at least one continuous jet through an orifice of small size called a nozzle. The jet is transformed into a regular succession of droplets of identical size under the action of a periodical stimulation system (not illustrated) located upstream of the nozzle outlet. If the droplets 7 are not intended for printing they are directed towards a gutter 62 where they are collected for recycling of the non-used ink through the ink circuit 4. Devices 61 placed along the jet (charge and deflection electrodes) when so commanded allow the electrical charging of the droplets and the deflection thereof into an electric field Ed. They are then deflected from their natural pathway when ejected from the droplet generator. The droplets 9 intended for printing are not driven into the gutter and come to be deposited on the substrate to be printed 8.

This description can be applied to so-called binary or multi-deflection continuous inkjet printers (CIJ). Binary CIJ printers are equipped with a head whose droplet generator has a plurality of jets, each droplet of one jet only being oriented towards 2 trajectories: printing or recovery. In multi-deflection continuous inkjet printers each droplet of a single jet (or of a few spaced apart jets) can be deflected over various trajectories corresponding to different charge commands from one droplet to another, thereby achieving scanning of the zone to be printed in a direction which is the direction of deflection, the other scanning direction of the zone to be printed being covered by relative movement of the print head and of the substrate to be printed 8. In general, the parts are arranged so that these 2 directions are substantially perpendicular.

An ink circuit in a continuous inkjet printer first allows ink under regulated pressure, and optionally solvent, to be supplied to the droplet generator of the head 1 and secondly creates negative pressure to collect fluids not used for printing that are returned from the head.

It also allows the managing of consumables (dispensing of ink and solvent from a reservoir) and the control and maintaining of ink quality (viscosity/concentration).

Finally, other functions are related to user comfort and the automatic taking in charge of some maintenance operations to guarantee identical functioning irrespective of the conditions of use. These functions include solvent rinsing of the head (droplet generator, nozzle, gutter) assisted preventive maintenance such as the replacement of components having a limited lifetime (filters, pumps).

These different functions have most different end purposes and technical requirements. They are actuated and sequenced by the controller 5 of the printer which is all the more complex the greater the number and sophistication of these functions.

Some current printers are designed to be modular for extreme facilitation of maintenance of the machine through rapid replacement and without special tooling for some modules. These may form more or less complex functional sub-assemblies of which one or more elements are components of limited lifetime (e.g. wear components) or components whose performance deteriorates with use (e.g. fouling of filters). In general this solution entails additional costs for strict obtaining of the function fulfilled by the module since an independent structure must be provided for the module, electrical connectors, hydraulic connecting members optionally self-closing to prevent the flow of fluids during replacement of the module, and various other components which would not be necessary if there were no modular design.

An example of a modular device is given in FIG. 1 in document WO2012066356. The hydraulic circuit illustrated therein uses exchangeable modules (references 50, 60 in FIG. 1). This circuit is most complex using a high number of components; in particular it uses numerous self-closing connectors (73) to isolate the modules (50 and 60) from the body of the ink circuit at the time of disconnection and thereby avoid the flow of fluids.

In other words, the presence of complex, block-exchangeable modules generates major technical complexity and hence incompatible additional costs.

At the current time, facilitated maintenance leads to an increase in the costs of the machine. The relative positioning of the fluid-retaining components interconnected together leads to constraints related to the gravity flow of the fluids.

More generally, to provide the user with ever better comfort of use, performance levels ever more technically advanced allowing applications to be addressed that are ever more difficult to meet, today's printers are of increasing complexity in terms of sophistication and number of components.

Another example is given in application WO2009049135.

According to another aspect of known machines, the forced circulation of fluids and the control over their flow (closing/opening of lines, routing) are functions which are costly to achieve in particular for reasons of reliability of operation. They generally make use of pumps and valves or solenoid valves or flap valves in particular to ensure the pressurizing of the ink and optionally of the solvent towards the head, the setting up of negative pressure for collection and purge from the head, or the transfer of ink or solvent from one point to another within the ink circuit.

According to yet another aspect of known machines, the vast majority thereof use geared pump technology to pressurize the ink and in some cases to set up negative pressure for recovery. These high performance and high capacity pumps are most suitable from a technical viewpoint. In particular they can treat difficult inks and have a long lifetime. However they are most costly.

In general, the ink circuit of known machines remains a costly part on account of the numerous hydraulic components required.

The problem is therefore raised of producing all or part of the functions of an ink circuit in a printer of CIJ type at lower cost and with a reduced number of components, whilst guaranteeing minimum reliability. It is therefore sought to use the least number of components possible in particular for functions such as the management of consumables and/or the control and maintaining of ink quality and/or solvent rinsing of the head.

In particular, one problem is to reduce the number of hydraulic components and to simplify the interconnection of these components. Despite this, user satisfaction must be ensured which means that efforts for this reduction in the number of components must not affect performance or reliability.

Another problem, related to the complexity of currently known machines, is the need for highly qualified operators. For example, maintenance sequencing may be very complex.

There is therefore a need for a printer adapted to handling by operators of little training.

An additional aspect is that ink circuits comprise a high number of hydraulic, hydro-electric components, sensors etc. Modern printers have numerous increasingly more sophisticated, precision functions. The hydraulic components (pumps, solenoid valves, self-closing connections, filters, various sensors) are present or are sized to meet a level of quality, performance and user service. And the maintenance functions are component-consuming since they are often automated.

There is therefore also a need for an ink circuit architecture which minimizes the number of components whilst guaranteeing good performance and reliability, ease of maintenance to allow rapid servicing, minimizing risks of spillage and able to be carried out by an operator without any particular training.

The problem is also raised of finding an architecture for regulating the fluids (solvent, ink) in the ink circuit of a printer. Said architecture should also minimize the number of components and allow the use of less costly components whilst guaranteeing good levels of performance and reliability.

SUMMARY OF THE INVENTION

Disclosed is a pumping circuit, in particular for fluid of an ink circuit in a continuous inkjet printer, comprising:

a diaphragm pump, an inlet circuit, or inlet means, comprising an inlet conduit into said pump for the fluid to be pumped, an outlet conduit for the fluid pumped by said pump, means for regulating the pressure and flow rate of fluid at the outlet of the pump, these means comprising a back-flow line which removes only part of the pumped fluid, downstream of the pump, and returns it to the inlet circuit of fluid to be pumped, at least one singular restriction being arranged on the path of the fluid in the back-flow line.

A pumping circuit is disclosed, in particular for fluid of an ink circuit in a continuous inkjet printer, comprising a diaphragm pump, an inlet circuit comprising an inlet conduit into said pump for the fluid to be pumped, an outlet conduit for the fluid pumped by said pump, said pumping circuit comprising a back-flow line which removes, from the outlet of said pump, or downstream of said pump, only part of the pumped fluid and returns it to the inlet circuit of fluid to be pumped, at least one singular restriction being arranged on the path of the fluid in the back-flow line, said back-flow line regulating the pressure and the flow rate of the fluid at the outlet of said pump.

Thus arranged, the by-pass or the back-flow line or the feedback line acts as means for regulating the pressure and flow rate of fluid leaving the pump. Said by pass or back-flow line or feedback line is disposed parallel to the circuit of the fluid pumped by the pump.

According to one embodiment, the back-flow line returns part of said pumped fluid towards said inlet conduit.

Preferably, the by-pass line returns part of said pumped fluid directly towards said inlet conduit without any intermediate reservoir or cartridge, at a point located upstream of the pump in the direction of circulation of the fluid. In other words, the fluid is directly returned, via the restriction, to a point arranged between a fluid cartridge and the pump itself.

The fluid can be a solvent, the said inlet circuit being able to contain a cartridge to contain said solvent.

The circuit may contain means to reduce pressure fluctuations due to the functioning of the diaphragm pump.

Said means for reducing pressure fluctuations due to functioning of the diaphragm pump can comprise a cavity arranged downstream of the pump and upstream of the by-pass line, to contain a volume of said solvent.

An outlet conduit of the fluid pumped by said pump can lead into a so-called lower part of the cavity, and a conduit connected to the back-flow line leading into a portion located above this lower part.

The cavity can comprise an outlet towards an outlet conduit for the fluid.

The circuit can comprise a valve whose position allows fluid to be brought towards the back-flow line.

According to another embodiment the circuit can comprise a viscous leak, or means to create a pressure drop by friction loss, in series with said singular restriction in said back-flow line.

The said circuit can comprise a reservoir to contain said fluid, an inlet conduit of the pump inletting fluid from said reservoir, the back-flow line returning part of said pumped fluid towards this reservoir.

The circuit can further comprise means for measuring a filling level of the reservoir.

Said pumping circuit is well adapted if the fluid is a mixture of solvent and ink.

The pumping circuit can further comprise means for filtering the fluid pumped by the diaphragm pump.

It can further comprise means to reduce or to damp pressure fluctuations due to functioning of the said pump.

For example, said means to reduce or to damp pressure fluctuations can comprise at least 2 bellows hydraulically connected by a hydraulic pressure drop connection.

The circuit can comprise means for measuring the pressure of said fluid downstream of said pump. Preferably, said means further allow measurement of the temperature of said fluid.

In a preferred embodiment, the pumping circuit further comprises a valve whose position allows fluid to be brought to the back-flow line.

The invention further concerns an ink circuit for continuous inkjet printer comprising:

a solvent pumping circuit as disclosed above, and/or an ink pumping circuit as disclosed above.

This ink circuit of a continuous inkjet printer can further comprise means to pump a mixture of ink and air from a print head of the printer, for example said means comprising a diaphragm pump.

In a preferred embodiment, the pump for pumping ink and the means for pumping a mixture of ink and air from a print head form part of a removable assembly, removable from the remainder of the ink circuit.

Said assembly, or removable assembly, may for an ink circuit of a continuous inkjet printer, comprise a plate having a first fluid inlet, a second fluid inlet and a third fluid inlet and a first fluid outlet, a second fluid outlet, and a third fluid outlet, this assembly further comprising:

a first pump, a second pump and a filter, fluid connection means to allow fluids to flow:

between said first fluid inlet, the first pump and said first fluid outlet, between said second fluid inlet, the filter and said second fluid outlet, and between said third fluid inlet, said second pump and said third fluid outlet, means for mounting and dismounting the assembly on the ink circuit.

The ink circuit can comprise means for pumping ink from an ink cartridge, for example a diaphragm pump.

Preferably, said means for pumping ink from an ink cartridge also allowing the injection of solvent into a reservoir intended to contain a mixture of ink and solvent.

The ink circuit can further comprise a valve of which one position allows circulation of ink from said ink cartridge towards the means for pumping ink from an ink cartridge.

The invention further concerns a continuous inkjet printer, comprising:

an ink circuit as disclosed above, a print head connected to the ink circuit via a flexible umbilical cable containing firstly hydraulic connection means to bring printing ink from the ink circuit to the print head and send ink to be recovered from the print head towards said ink circuit, and secondly electrical connection means.

DESCRIPTION OF THE DRAWINGS

FIG. 5 gives operating curves of a circuit comprising a diaphragm pump and a singular restriction;

FIG. 6 gives operating curves of a circuit comprising a diaphragm pump, a singular restriction and a restriction forming a viscous leak.

FIGS. 10A-10D illustrate dismounting steps of a removable component or module in one embodiment of a fluid circuit;

DETAILED DESCRIPTION OF EMBODIMENTS

According to one example of embodiment, the invention uses a diaphragm pump and its regulation circuit.

A diaphragm pump comprises a cavity whose volume is alternately caused to be variable via the back and forth movement of a piston actuated by a motor. Two flap valves operating in opposition are placed between the cavity and respectively a fluid inlet path and a fluid outlet path. The inlet flap valve opens when the volume of the cavity increases (respectively the outlet flap valve closes) and it closes (respectively the outlet flap valve opens) when the volume of the cavity decreases. The duty point, characterized by the flow rate/pressure (or flow rate/vacuum) pair provided by the pump will depend on the viscosity of the fluid, on the pressure drop in the inlet and/or outlet lines, on the power supplied to the motor (torque/speed) and on the characteristics of the pump parts.

Figure 3:
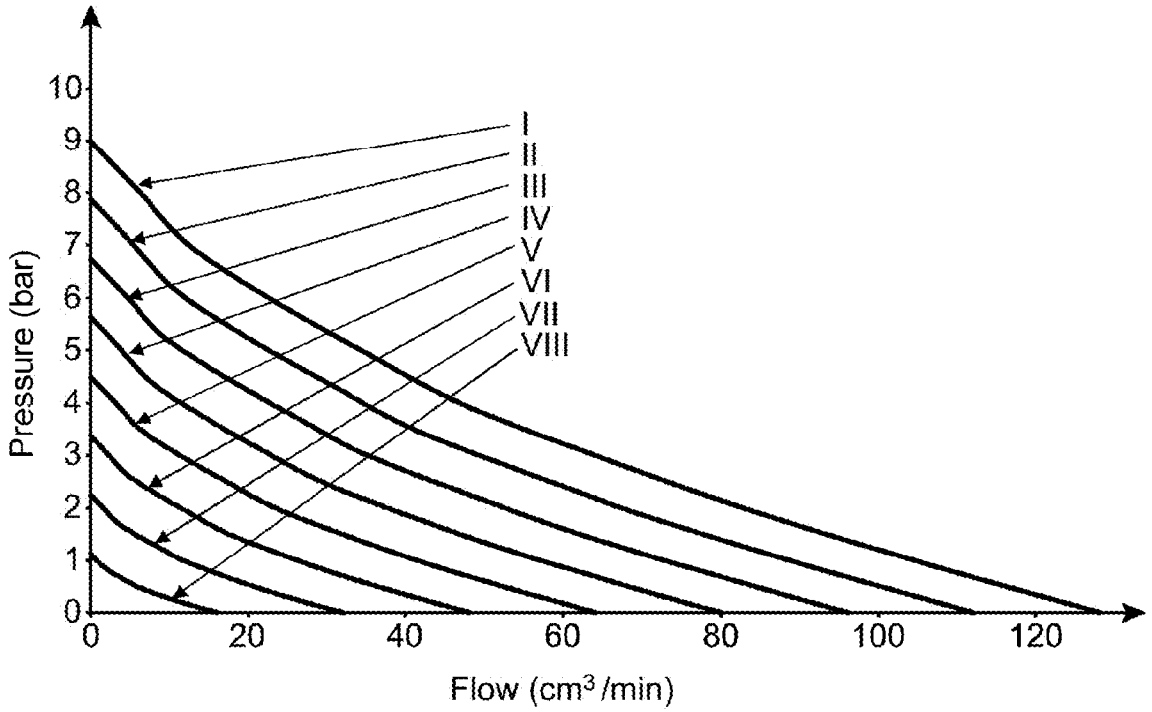
FIG. 3 gives operating curves of a diaphragm pump.

The performance of a pump is characterized by a network of curves giving the pressure or vacuum obtained as a function of flow rate for different powers supplied to the motor, one example of these curves being given in FIG. 3.

This Figure gives a network of curves defining the characteristic of pressure behaviour as a function of flow rate of a diaphragm pump used as an example. For a given command voltage, the characteristic is a decreasing function, which starts at a maximum pressure for a zero flow rate and reaches zero pressure for a maximum flow rate called free flow rate. Each curve is defined by a given operating voltage (and hence by a given speed of rotation) as per Table 1 below:

TABLE I

| Operating voltage (in Volts) | rotation speed (in tr/mn |
|---|---|
| )24 (curve I) | 3700 |
| 22 (curve II) | 3300 |
| 20 (curve III) | 2900 |
| 18 (curve IV) | 2600 |
| 16 (curve V) | 2200 |
| 14 (curve VI) | 1800 |
| 12 (curve VII) | 1400 |
| 10 (curve VIII) | 1000 |

The power supplied to the motor (which may be of <<brushless>> technology for example, for which the supply voltage determines the speed of rotation hence the cycle frequency of the pump) is directly related to the command voltage of the motor which translates as a given speed of rotation.

Figure 7A:
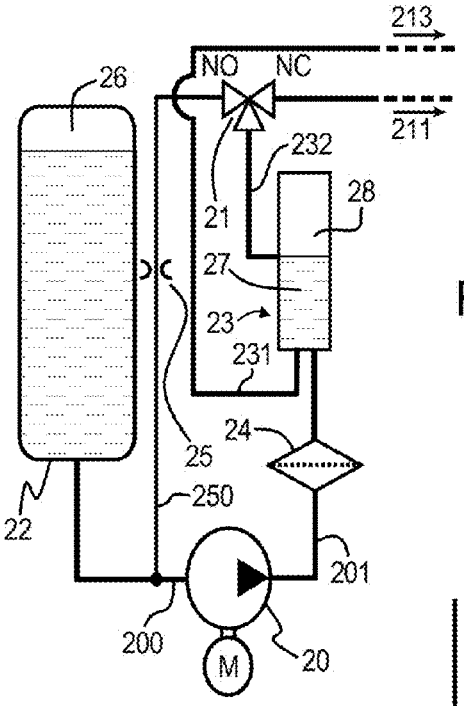
FIGS. 7A and 7B are examples of application of the fluid circuit schematics in FIGS. 4A and 4B.
Figure 7B:
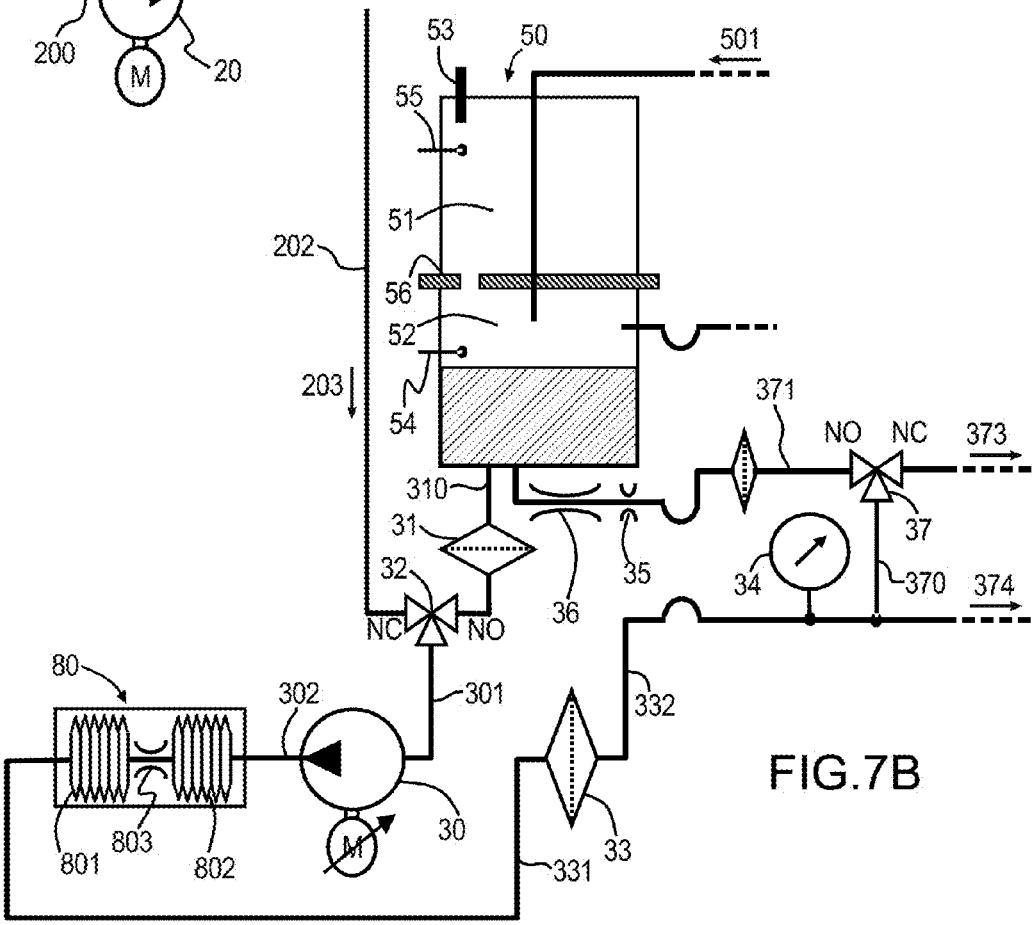
Figure 8:
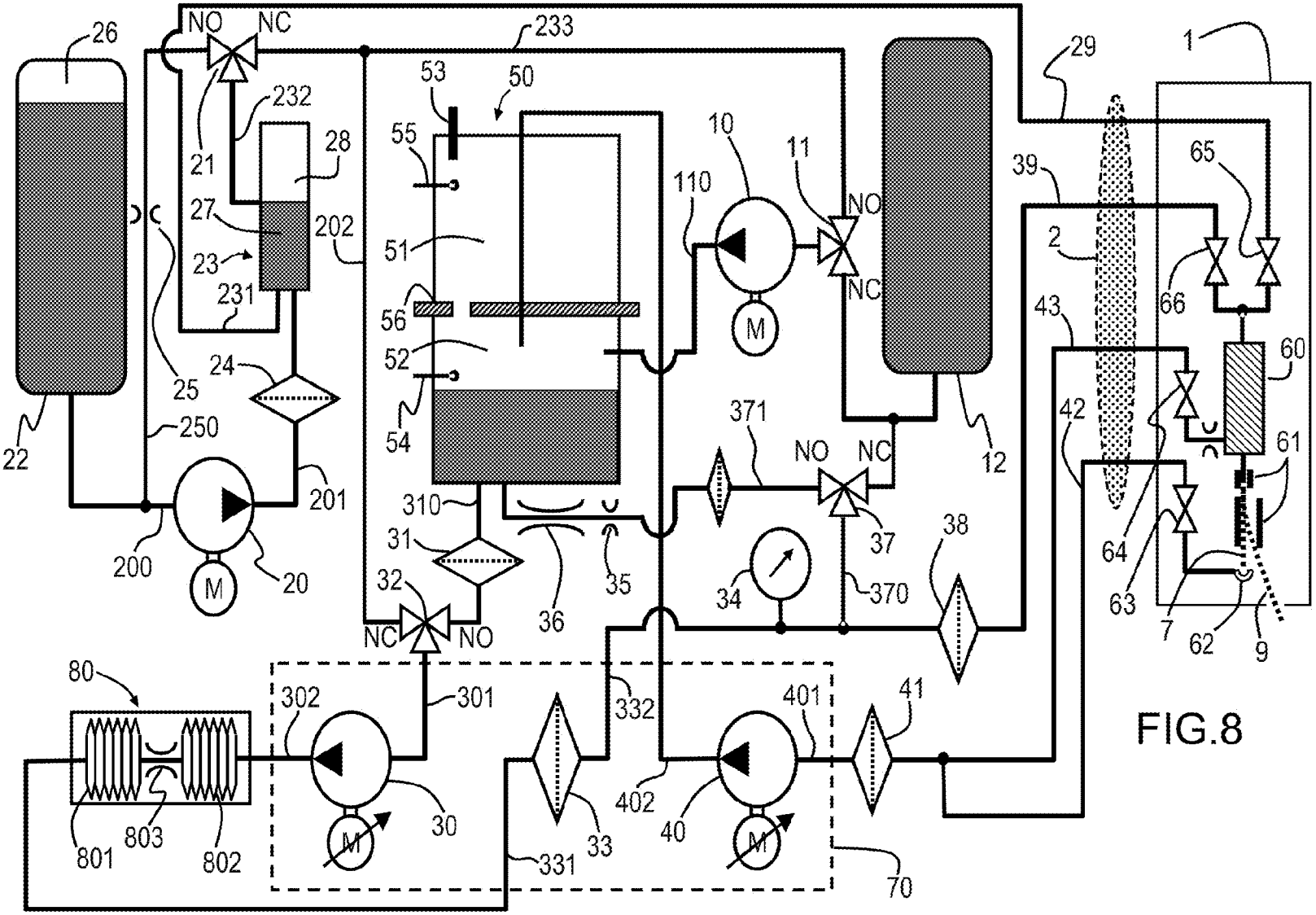
FIG. 8 gives an example of embodiment of a hydraulic scheme for CU-type printer.

This type of pump has certain characteristics:

- the pump when at rest is in the through-state in the direction from the inlet to the outlet (see the direction of the apex of the triangles arranged in each of the pumps in FIGS. 7A, 7B and 8) and in a non-through state in the opposite direction;
- it is self-priming, in the limit of its air suction capacity if a column of liquid is to be lifted. For proper functioning it is preferable that the pump is in load, or submerged, at rest as well as its upstream hydraulic circuit;
- its lifetime, characterized by a number of cycles before failure under given environmental conditions (temperature, pressure, flow rate, fluid composition), is limited.

The motorisation, whose choice is partly determined by the expected cost of the pump, and the limited performance level of this type of pump have consequences on the functions of ink pressurization and recovery.

In particular, as explained below, the duty point determined by the supply voltage of the motor and the back-flow rate defined by a singular restriction 35 do not entirely cover the expected scope of operation of a printer (in particular the extent of variation in temperature withstood by the inks).

However these pumps can replace other pumps, in particular gear pumps usually used for an ink circuit.

They can be used here for:

- the transfer of ink or solvent from one point to another in the ink circuit; in this case the pressure (or negative pressure) to be obtained with said pump allows static pressures of the fluids to be overcome related to the different levels between the origin and destination of fluid transfer;
- the setting up of negative pressure for recovery and purging from the head;
- the pressurizing of ink and optionally of solvent towards the head.

Since this type of pump when at rest is in a through-state (or flow or throughflow direction) in one direction, the flow can be blocked either by inter-positioning a hydraulic member (e.g. a solenoid valve) or by avoiding a difference in positive pressure between the inlet and outlet of the pump.

The quantity of liquid transferred by a pump can be evaluated by a number of pump cycles, the hydrostatic conditions upstream and downstream of the pump being kept within known values (to within the desired accuracy); the quantity of fluid displaced per cycle can be previously identified (in general by experimentation) under these conditions.

It can be noted that, for a diaphragm pump, the setting up of negative pressure for recovery and purging from the head is restrictive. The fluid suctioned from the gutter is two-phase (air+ink) since recovery is obtained by air entrainment effect on the ink. This requires a major air flow-rate characteristic (high cycle frequency) and almost permanent demand placed thereupon during the functioning of the printer.

Figure 4A:
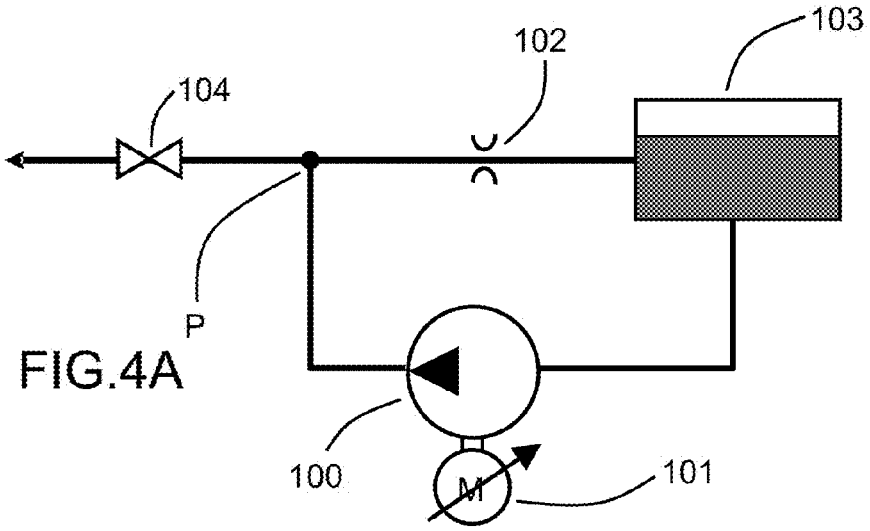
FIGS. 4A and 4B are schematics of fluid circuits provided with a singular restriction optionally in series with a restriction forming a viscous leak (FIG. 4B).

One example of the regulated pressurizing of a pumped fluid (for example the ink and optionally the solvent of a circuit such as described above) by a diaphragm pump can be explained with reference to FIG. 4A.

This schematic illustrates a diaphragm pump 100 actuated by the motor M itself supplied with a given power.

This pump allows a fluid to be pumped from a reservoir 103.

At the outlet of the pump the fluid can either return to the reservoir via a singular restriction (pressure drop) 102 or escape via a valve 104.

It is specified that a singular restriction is a localized narrowing of a fluid conduit whose length L is smaller than its diameter d or short compared to its diameter, and which creates a pressure drop insensitive to the viscosity of the fluid passing through it. Advantageously $L/d \leq 1/2$; according to some examples L/D is between ¼ and ½ (e.g. D=0.3 mm and L=0.1 mm). It is possible to use a restriction having special behaviour in which L/D is higher than 1 and may reach 10 (in other words, $1 \leq L/D \leq 10$).

When the valve 104 is closed, the pump causes the fluid to circulate in the loop which starts at the reservoir 103, passes through the pump 100 and returns to the reservoir 103 via the restriction 102.

However the flow rate Q of a singular restriction (whose length is short compared with its diameter) is dependent on the pressure difference ΔP at its terminals through the equation $\Delta P = Rh(\rho) \times Q^2$, where Rh is hydraulic resistance dependent on the density p of the fluid but very little upon its viscosity.

FIG. 5 illustrates the network of curves (pressure as a function of flow rate) of the pump used as an example, these curves being defined by a given operating voltage (and hence by a given speed of rotation) in accordance with Table 1 given above.

Also, the characteristic ΔP is given as a function of Q of the singular restriction used in the example for 3 different temperatures (T1=0° C., T2=25° C., T3=50° C.).

It is noted that the characteristics of this type of restriction depend very little on temperature since they are sensitive to the density of the fluid which itself is scarcely dependent on temperature for the inks usually used.

It will be understood that having regard to the flow rate/pressure characteristics of the pump, equilibrium is set up at the intersection of the characteristic curve of the pump defined by the control voltage of the motor and the restriction curve. A duty point is thereby defined which relates the power supplied to the motor with pressure (FIGS. 3 and 5).

The pressure supplied by the system can therefore be commanded and/or regulated by acting on the power supplied to the motor. A pressure regulation system can therefore be used and the motor power adjusted to reach a previously defined set pressure.

When the valve 104 is open the pump outlet flow rate increases and, in accordance with the curves of pump characteristics, this causes the pressure to be lowered. The regulation system can correct the commanding of the pump, in particular if high precision is required, to restore the pressure insofar as the flow rate added by opening the valve is low compared with the flow rate through the restriction 102.

FIG. 7A illustrates an embodiment of a circuit allowing the pressurizing of a fluid, such as explained above, to pump a solvent contained in a solvent cartridge 22.

It is specified that, both in this Figure and in FIG. 8, the cartridges 12, 22 are removable and accessory to the described circuit.

The solvent is brought from a cartridge 22 by means of a diaphragm pump 20. It can be dispensed by means of this same pump 20 and from a circuit not illustrated in detail in this Figure, towards a main ink reservoir or towards other parts of the system e.g. towards a print head (not illustrated), at a pressure close to the ink pressure to allow the change-over of the jet to solvent without destabilizing the jet (risk of soiling) in order to clean the head. It also allows cleaning of other parts of the system. The dotted lines in FIG. 7A illustrate the dispensing of solvent towards these different parts of the system.

Preferably, a filter 24 is arranged on the path of the solvent, downstream of the pump.

Reference 21 designates a valve of <<1-2>> type (1 inlet-2 outlets) which allows the dispensing of solvent towards the other parts of the system.

In the embodiment of FIG. 7A, the solvent pump 20 e.g. through a filter 24, feeds a cavity 23 via an inlet located in a so-called lower part thereof. The upper part of the cavity is insulated and encloses an air bubble 28. Another connection point called median connection, located above the inlet arranged in the lower part, connects the cavity 23 to the inlet of the valve 21. As soon as the pump 20 is set in operation, the level of solvent passes above the median connection point and the air bubble is isolated; the solvent circuit is placed under pressure and solvent can be sent for example to a reservoir and towards other elements (arrows 211, 213).

When the valve 21 is at rest (NO), the solvent circuit is configured to feed solvent under a pressure close to the pressure of the ink when the jet is formed at the head (this is the case when cleaning the head 1). The median take-off is recycled towards the inlet of the pump 20, advantageously through a singular restriction 25, which allows convenient regulation of the pressure and flow rate of solvent by the pump 20, as explained below with reference to FIG. 5. Advantageously, the outlet of the restriction leads directly to the intake of the pump via which the solvent arrives from the cartridge 22, or to a point on the conduit 200 (which brings the solvent from the solvent cartridge) arranged upstream of the pump 20, between the outlet of the solvent cartridge and the intake of this same solvent in the pump. If the pressure is insufficient in the cavity 23, the flow rate in the restriction 25 will drop, as in the pump 20, and, since the operating voltage of the pump has not varied, the pressure of the pump will increase, conforming to the curves in FIG. 5. This will tend to increase the pressure at the terminals of the restriction, hence increase its flow rate, conforming to the curves in FIG. 5 (in which it can be seen that the pressure/flow rate characteristic of the pump, with command being constant, has a negative slope).

It will therefore be understood that an equilibrium situation may result from this system in which, for a given pressure in the cavity, the flow rates of the restriction and of the pump are identical. The variation in volume of solvent in the closed circuit, due to variations in volume of the air bubble, is naturally offset by a supply of solvent from the solvent cartridge which is directly connected to the intake of the pump 20.

Said circuit further comprises means for reducing pressure fluctuations due to functioning of the diaphragm pump.

Thus, when the pump 20 is set in operation, the pressure increases in the cavity and compresses the air bubble. This then acts as the anti-pulse system 80 and damps the pressure waves caused by the diaphragm pump. The solvent may take the median conduit towards the restriction 25 whose flow rate is determined by the pressure difference at its terminals. It is noted that this cavity 23 has the sole function of reducing pressure fluctuations, but does not take part in regulating the pressure and flow rate of the pump. In other words, a regulation loop with the restriction 25 can be used without the said cavity 23.

When the valve 21 is actuated (NC) the solvent circuit is configured to feed solvent at low pressure (the case when it is sought to correct viscosity). When the pump 20 is set in operation, solvent drawn from the cartridge 22 is brought into the cavity 23 and causes compression of the air bubble until the pressure drop in the circuit, comprising valve 21 and the other elements downstream of it, is overcome and the solvent is able to flow into the target elements (main reservoir for example). The flow characteristics of this circuit can be experimentally identified to relate the actuation time of the pump 20 with the quantity of transferred solvent. These data can be memorised by the control means.

This is the scheme used in the solvent circuit in FIG. 8 explained below, with the pump 20 and the restriction 25 arranged on a by-pass line of this pump.

Figure 4B:
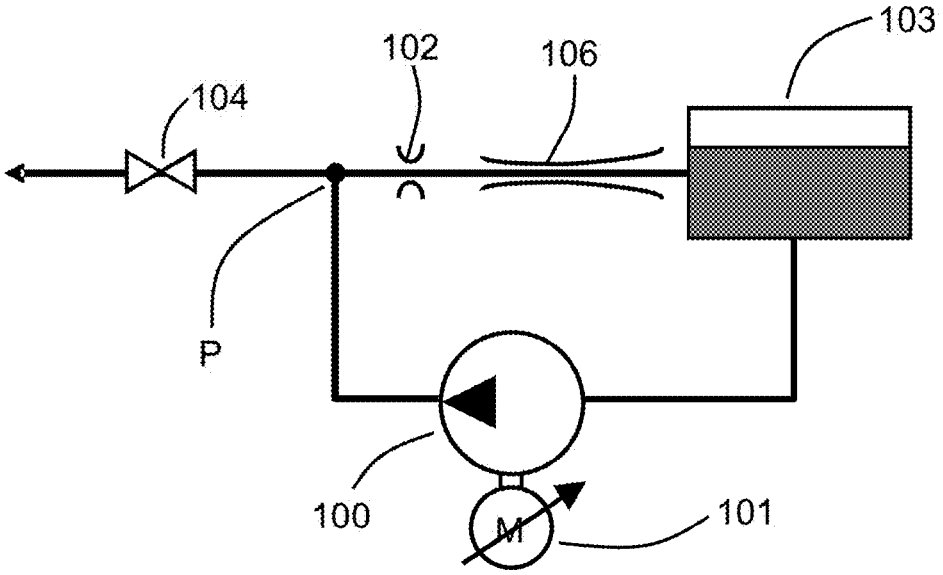

FIG. 4B illustrates another embodiment of the regulated pressurizing of a pumped fluid (e.g. the ink in an ink circuit of a continuous inkjet printer) by a diaphragm pump. The references are those of FIG. 4A with in addition a line pressure drop restriction 106 arranged in series with the singular restriction 105.

A viscous leak (or means to create a pressure drop by friction loss) can be formed by means of a narrowing of a fluidic duct which is substantially longer than its diameter.

This kind of restriction can comprise for example a pipe of length between 50 cm and 1 m and diameter of between 0.5 mm and 2 mm. Its behaviour obeys a different law to that of a singular restriction. The relationship between the difference in pressure $\Delta P$ at its terminals and the flow rate Q is the following: $\Delta P = Rh(\mu) \times Q$, where Rh is the hydraulic resistance which is dependent in a linear fashion on the viscosity of the fluid $\mu$.

A viscous leak 36 or means 36 to create a pressure drop by friction loss comprises a narrowing which is long compared with its diameter, setting up a pressure drop sensitive to, or dependant on, the viscosity of the fluid circulating therein. A viscous leak 36 or means 36 to create a pressure drop by friction loss comprises a narrowing of a fluid conduit whose length L is substantially greater than its diameter D. Advantageously L/D is equal to or higher than 100, for example in the order of 500 (e.g. L=500 mm for D=1.1 mm). It is also possible to use a restriction having special behaviour for which L/D is equal to or higher than 10 (in other words, $L/D \geq 10$).

The inks used in CIJ printers have viscosities which are highly dependent on their temperature. To maintain jet velocity constant when the temperature varies, the jet velocity regulating system, as we have seen, adjusts the pressure of the ink by acting on the voltage of the motor of the pump 30. Therefore:

- at low temperature the pressure will be high and more demand will be placed on the pump;
- conversely, at high temperature the pressure will be lower and less demand will be placed on the pump.

If the two types of restrictions are placed in series (viscous leak 106 and singular restriction 105) in the pump back-flow (as illustrated in the schematic in FIG. 7B), the characteristics $\Delta P$ as a function of Q will then be of the type of those illustrated in the graph in FIG. 6. It can be seen here that the characteristics strongly depend on the temperature of the ink (T1=0° C., T2=25° C. and T3=50° C.). The duty point of the pump will therefore change as a function of temperature.

According to one aspect of the invention, the use of a viscous leak in the back-flow of a diaphragm pump allows an improvement in two detrimental aspects related to the use of this type of pump:

- its lifetime is strongly dependent on the demand placed upon it (power, speed of rotation). In the application described here, the duty point shifts favourably as a function of temperature since its trend tends to reduce stress on the pump whilst the jet velocity regulating system, at the same time, tends to increase this stress. Overall, the lifetime of the pump is therefore improved;

the operating range of the printer as a function of ink circuit temperature applicable without adjustment (optionally manual) is thereby widened and allows coverage of a broader field of application of the printer. This offsets part of the performance limits of diaphragm pumps.

FIG. 7B illustrates an application for pumping ink contained in a reservoir 50, called main reservoir, which contains ink ready to use by a head for printing i.e. a sufficient reserve and of suitable quality (viscosity/concentration). This reservoir may also be the return destination for ink recovered from a print head (not illustrated in FIG. 7B). This ink return is schematized by an arrow 501 in FIG. 7B.

References 31 and 33 designate filters.

Preferably, a filter screen (or strainer) 31 protects the circuit against coarse impurities originating from the reservoir.

A filter upstream of a restriction 35 protects the latter against pollution which may risk fouling or clogging thereof.

Filter 33, called main filter, is used to get rid the ink of impurities which might perturb the formation of droplet jets. This may have high filtering capacity; its lifetime is preferably equivalent to that of the pump 30.

In the embodiment described here, a solenoid valve 32 is normally in open position to allow the passing of ink from the reservoir 50 and to pump 30. This solenoid valve 32, when placed in its other state i.e. closed to prevent the flow of ink from the reservoir 50 but open to allow the passing of another flow (arrow 203), for example solvent, allowing rinsing of the pump 30 by the solvent.

As a result, the pump 30 draws ink—when the solenoid valve 32 is not commanded to be in a state other than its <<normally open>> state—from the reservoir 50, through the filter screen (or strainer) 31, and places it under pressure.

Preferably the ink circuit comprises means to damp ink pressure fluctuations or waves caused by functioning of the pump, bringing them to within a few mb. More specifically, via the opening and closing action of the flap valves of the pump 30, the fluid flow is periodically switched between zero pressure and a given pressure, the mean value lying between 2 and 4 bars. This fluctuation may be major and scarcely compatible with the functioning of a CIJ printer. The droplet charging system is synchronized with a phase of the stimulation signal locked on the time when the droplet separates from the jet. Yet this instant is defined for a given jet velocity; any variation in jet velocity induced by these still perceivable pressure fluctuations would periodically de-synchronize the charge in relation to the droplet separation time which would perturb the droplet trajectories and hence the quality of printing.

Said means for damping ink pressure fluctuations or waves are advantageously arranged here at the outlet of the pump 30. In the illustrated embodiment they comprise an <<anti-pulse>> device 80. This itself comprises two bellows 801 and 802 hydraulically connected via a hydraulic pressure drop connection 803. The assembly can be calculated to have optimum efficiency in the frequency bandwidth used by the pump.

The ink is then able to pass through a filter, called main filter 33.

Preferably a branch of the ink circuit, downstream of the pump 30 and of the filter 33, allows part of the ink under pressure to be sent towards the main reservoir 50 thereby creating a back-flow (or feedback) of the pump 30. A 2-way solenoid valve 37 (one inlet towards two outputs) can be arranged on the pathway of the ink, downstream of the pump 30 and of the filter 33; this valve in rest position is normally open (<<NO>>, as indicated in FIG. 7A) so as to allow part of the pressurized ink to circulate towards the reservoir 50. On this portion of the pathway there are arranged a singular restriction 35 and a viscous leak 36 or means 36 to create a pressure drop by friction loss to regulate the ink pressure and flow rate as explained below with reference to FIG. 6.

Advantageously in its other position, the valve 37 facilitates maintenance: it is possible at any time to recover all the ink present in the circuit and to transfer it (arrow 373) towards a cartridge allocated to recovery. Switching of the valve 37 to the open position towards this cartridge allows the sending of ink thereto from the circuit passing through the pump 30.

The remainder of the ink is sent (arrow 374) towards a print head (not shown on that figure).

An example of a hydraulic scheme for a CIJ-type printer is illustrated in FIG. 8. The sub-assembly 1 on the right of the scheme represents the hydraulic part of the print head designed to be connected to the ink circuit. This schematic reproduces the elements described above in connection with FIGS. 7A and 7B. Some reference numbers have therefore been re-used in these Figures and designate the same elements therein which will therefore not be further described in detail (reference to the above description being sufficient).

The dotted ellipse 2 symbolises the umbilical cable, generally several meters long, connecting the ink circuit to the head 1. For example it may contain at least the 4 lines or conduits for hydraulic management of the head: the ink conduit 39, the recovery conduit 42, the purging circuit 43 and the solvent conduit 29. A fifth conduit or line may also be provided to bring a gaseous fluid towards the head for pressurising needs.

Figure 2:
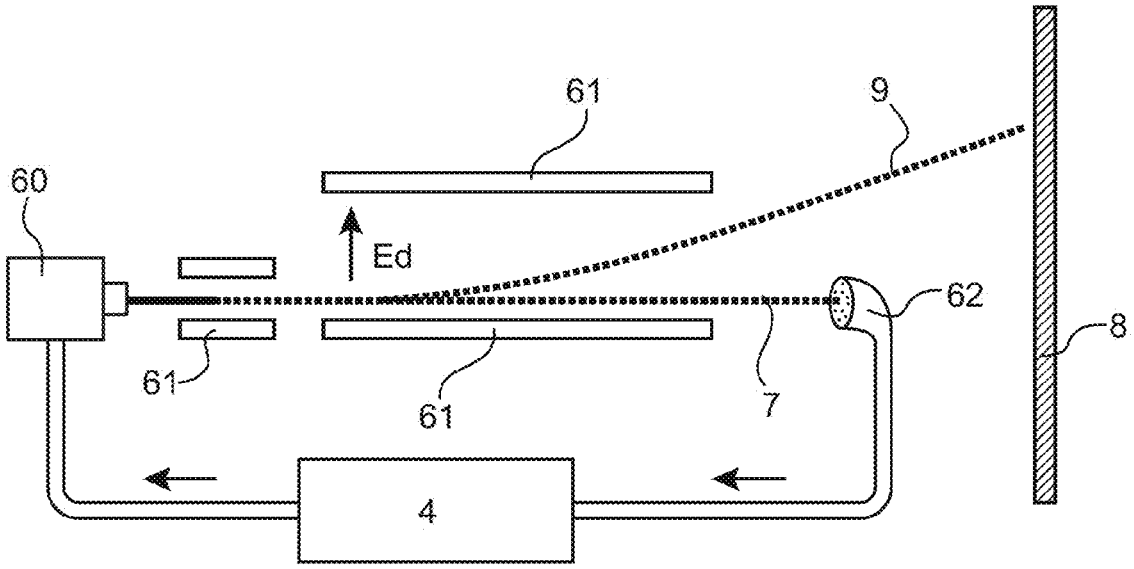
FIG. 2 illustrates a known structure of a print head for a printer of CIJ type.

The head 1 comprises a solenoid valve 63-66 for each of the lines transiting via the umbilical cable. It also comprises elements 60-62 already described above with reference to FIG. 2.

Figure 1:
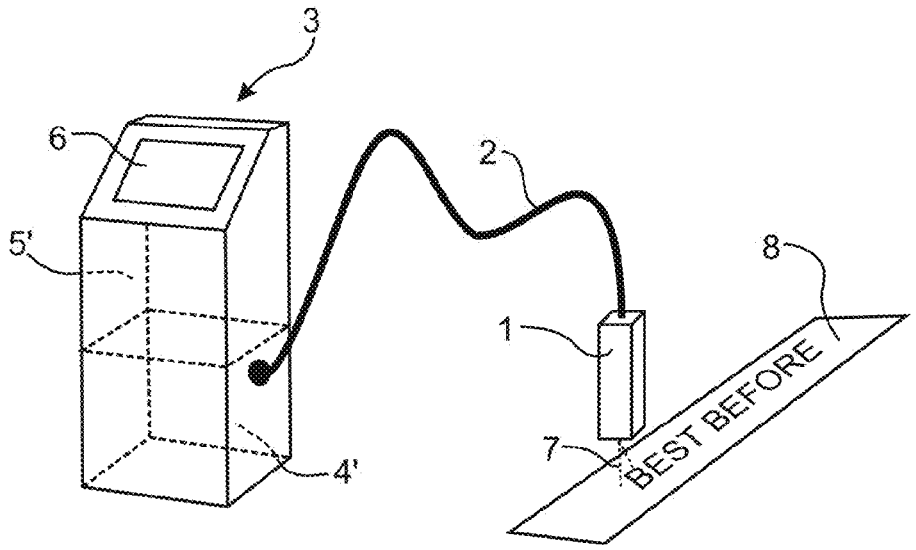
FIG. 1 illustrates a known printer structure.

The remainder of the scheme on the left of the umbilical cable 2, concerns the ink circuit itself installed in zone 4' of the printer body or console or cabinet (in FIG. 1). Controlling of the ink circuit can be obtained by means of a controller card installed in zone 5' of the printer body.

It can be seen in FIG. 8 that the number of components in this circuit is reduced compared with prior art ink circuit diagrams previously described and intended for top-range machines. Nevertheless, the basic functions and some of the functions described above remain operational without impairing the reliability of the ink circuit.

This example of a hydraulic circuit uses 4 pumps 10, 20, 30, 40 for the different functions of forced fluid circulation. In the rest of this description, pump 30 may also be called the first pump, and pump 40 may be designated as the second pump. Flow dispensing and/or control means in the ink circuit can be provided, for example in the form of solenoid valves, here two-way valves 11, 21, 32 and 37 which can only be 4 in number. Advantageously, these solenoid valves are identical since the required characteristics are substantially the same.

The pumps used here are preferably diaphragm pumps; each thereof fulfils a different function from each of the others.

The characteristics of these pumps are described further on.

The functions of forced fluid circulation included in the main hydraulic functions of the ink circuit are distributed among these pumps: regulated pressurizing of the ink, ink recovery; solvent pressurizing and dispensing, ink dispensing.

The references 110 200, 201, 231, 232, 250, 202, 233, 310, 301, 302, 331, 332, 401, 402, 370, 371 designate fluid connection means, in general portions of conduits or pipes which connect two elements of the circuit or an element of the circuit and an inlet or outlet port.

The reservoir 50, called main reservoir, contains ink ready to use by the head for printing i.e. a sufficient reserve of suitable quality (viscosity/concentration). It is also the return destination for ink recovered from the head 1 via the gutter 62.

References 12 and 22 respectively designate an ink cartridge and a solvent cartridge. These cartridges are removable and can easily be replaced. They supply the ink and solvent which allow the mixture to be formed that is contained in the main reservoir 50. The solvent is transferred from its cartridge 22 by the pump 20, and the ink is transferred from its cartridge 12 by means of pump 10.

The device may further comprise filters. References 24, 31, 33, 41 designate these filters.

A filter screen (or strainer) 31 can be provided to protect the circuit against coarse impurities originating from the reservoir. Another filter (e.g. 250 μm), upstream of the restriction 35, can be provided to protect the latter against pollution which may risk fouling thereof. Yet another filter 38 can be provided to protect the head against pollution which may infiltrate when disconnecting the head. Preferably, it retains impurities within the range of 30 μm-100 μm.

Preferably, a filter 33 called main filter has been described above. It is used to get rid the ink of impurities which might perturb the formation of droplet jets. This may have high filtering capacity; its lifetime is preferably equivalent to that of the pump 30.

Other filters or filter screens can be present in the circuit to protect the components when dismounting, and in particular when exposing circuits to open air which is generally polluted.

The power of the motor of the pump 30 can be controlled by controller-forming means. For example, these means comprise a micro-processor which transmits printing instructions to the head but also drives the system motors to manage supply to the ink circuit. They may also comprise means for comparing measured data, originating for example from sensors 34 or 54, with reference data to trigger necessary commands e.g. the supply of solvent to the reservoir 50.

In the embodiment described here, the fluid connection between the main reservoir 50 and this pump solely comprises a filter 31. A solenoid valve 32 is normally in open position (to allow the passing of ink from the reservoir 50). This solenoid valve 32, when placed in its other state i.e. closed to prevent the flow of ink from the reservoir 50 but open to allow the passing of solvent flow from the solvent cartridge 22, allows rinsing of the pump 30 by the solvent.

The ink is then able to pass through the means 80 forming <<anti-pulse>> device, through a filter 33, called main filter, and then a filter 38 called a head protection filter. Here again, the path followed by the ink is simple without any additional complex fluid component.

The ink is then sent by the umbilical line 39 towards the head via the solenoid valve 66.

In its normally open position, valve 37 sends the fluid towards reservoir 50, as explained above (FIG. 7B).

In its other position, the valve 37 facilitates maintenance: it is possible at any time to recover all the ink present in the circuit and to transfer it towards a cartridge 12 allocated to recovery. Switching of the valve 37 to the open position towards this cartridge 12 allows the sending of ink thereto from the circuit passing through the pump 30.

The remainder of the ink is sent towards the head 1 as described above.

As will be understood, the 2-way valves 32 and 37 are only commanded during maintenance sequencing.

The pressure of the ink can be measured at the outlet of the main filter 33 by means of the pressure sensor 34. Advantageously this sensor also allows measurement of ink temperature. This sensor can also be used by the controller to monitor the filling of the cartridge 12 during a maintenance operation to purge the circuit of ink. Indeed, when the cartridge is full the pressure in the circuit continuously increases. The controller can compare this value with a threshold which, if exceeded, causes the stoppage of pumping. Similarly, if the signal from the sensor becomes unstable whilst remaining weak, the controller can infer that the pump is agitating or churning air and that therefore the reservoir is empty.

The recovery and optionally purging of fluids from the head 1 is ensured by the pump 40 which sets up a negative pressure respectively applied to the recovery 42 and purge 43 lines of the umbilical cable. In the head 1, this negative pressure is transmitted to the gutter and the droplet generator under the control of the solenoid valves 63 and 64 respectively.

A protective filter 41, upstream of the pump 40, can be provided to retain polluting elements (particles) of large size which may have been aspirated into the gutter. The air/ink mixture leaving the pump is directly repelled towards the main reservoir 50.

Much demand is placed on this pump 40 since it operates permanently at fast rate and conveys a two-phase air/ink mixture. It is the free flow characteristic of the pump which is called upon here: the pump then operates with practically no pressure drop downstream, undergoes no or only little stress and provides no or little pressure. Control over the motor power allows adjustment of the gutter flow rate to recovery needs (these needs may change as a function of the conditions of use of the printer). This control can be performed by the controller which sends instructions in relation to various parameters (e.g. temperature) in particular to optimise solvent consumption.

The circuit associated with the pump 20 was described above with reference to FIG. 7A. Here the solvent can be sent towards the reservoir 50 and towards the pump 30.

When the pump 20 is set in operation, the pressure increases in the cavity and compresses the air bubble. This then acts as the anti-pulse system 80.

If the head cleaning valve 65 is open, the solvent under pressure is applied to the inlet of the droplet generator. The solvent consumed is then naturally drawn from the removable solvent cartridge 22 so as substantially to maintain an identical flow rate in the restriction 25 and the pump 20.

When the valve 21 is actuated (NC) (the case when it is sought to correct viscosity) the median connection of the cavity is placed in communication with the inlet, that is open and at rest, of the valve 11 which is of 2-1 type (2 inlets-1 outlet). The circuit continues through the pump 10, which even at rest is in the through-state (or flow or throughflow state), and arrives at the main reservoir 50. When the pump 20 is set in operation, solvent drawn from the cartridge 22 is brought into the cavity 23 and causes compression of the air bubble until the pressure drop in the circuit: valve 21—valve 11—pump 10 at rest—reservoir 50 is overcome and the solvent is able to flow into the reservoir 50. The flow characteristics of this circuit can be experimentally identified to relate the actuation time of the pump 20 with the quantity of transferred solvent. These data can be memorised by the control means.

The ink used in CIJ printers is partly composed of solvent that is often volatile. The circulation of this ink by the jet and the ink circuit causes evaporation of the solvent the result of which is to change the rheological characteristics (viscosity in particular) of the ink and to deteriorate the functioning of the machine. It is therefore sought to readjust the viscosity (or concentration) of the ink by periodically adding a quantity of solvent in relation to the level of viscosity change. Viscosity can be measured, for a given jet velocity servo-controlled by ink pressure, by identifying the pair (Pressure, Temperature) representing the viscosity of the ink. Knowing the difference in viscosity and the quantity of ink to be adjusted, the controller infers therefrom the quantity of solvent to be added and/or the actuation time of the solvent pump when the valve 21 is actuated.

The solvent, brought from the cartridge 22, can be dispensed by means of the pump 20 and dispensing means for example comprising a set of valves 11, 21, 32, 65:

- towards the main reservoir 50 and/or towards the motor 30 (for cleaning thereof) for example by means of a 2-way valve (1 inlet towards 2 outlets) 21 when so commanded (changeover to NC);
- towards the head 1, for cleaning thereof for example again by means of a valve such as valve 21, in this case not commanded, the solvent taking the NO pathway of the valve 21 to return to the inlet of the pump 20 (for example via a back-flow or a back-flow, as described above).

With this system it is possible to bring the solvent to the head at a pressure close to the ink pressure to allow the changeover of the jet to solvent without destabilising the jet (risk of soiling) in order to clean the head.

It also allows the dispensing of determined quantities of solvent towards the main reservoir 50, to correct ink viscosity.

The diaphragm pump 20 allows the dispensing of solvent. A filter 24 can be arranged on the pathway of the solvent downstream of the pump.

According to one embodiment, the valve 21, of <<1-2>> type (1 inlet-2 outlets), allows the dispensing of solvent towards the main reservoir 50 and towards the pump 30 if the valve 32 is switched to allow the passing of solvent thereto. The solvent is sent to the head 1 when the valve 65 is in open position. There is therefore no specific valve, in the part dedicated to managing the solvent, to send solvent towards the head 1.

In particular, the pump 30 is sensitive to drying of the ink in the event of a more or less extended period of non-use. To rinse the pump with solvent, solvent is sent to it (for example by actuating the valves 21 and 32) and the solvent pump 20 is set in operation; the solvent of cavity 23 is then propelled towards the pump in its through direction (or flow or throughflow direction). More generally, provision can be made so that all the hydraulic elements of the ink circuit and of the head are able to be reached by the solvent, following adapted sequencing of the pump or solenoid valve commands.

The main reservoir 50 is fed with ink as soon as the level, related to printing consumption, falls to below a certain value. For this purpose, the intake of the diaphragm pump 10 is connected to the ink cartridge 12 via the valve 11 which sets up a connection when it is actuated. The outlet of the pump preferably leads directly into the reservoir 50. The commands of the pump 10 and of the valve 11 can be associated with the low-level detector 51 to re-supply ink if the ink level falls below the detector 51. It is recalled here that the pump 10, on account of its technology, is in a through-state when at rest in the direction of active flow and, since the valve 11 when at rest connects the intake of the pump to the solvent function, the management of the ink does not interfere with the adding of solvent when it is at rest. In other words, the two functions of adding solvent and adding ink are made independent by the position of the valve 11 which causes the flows of solvent or ink to be exclusive.

Maintenance functions, preferably automated, can also be carried out.

For example a draining function of the main reservoir allows the content of the reservoir 50 to be led back to the cartridge 12. For this purpose, an empty (or rather non-full) cartridge is arranged at the location provided. In practice, a specifically packaged cartridge is used in which a vacuum has been set up; it comprises a flexible jacket or wrapping, the vacuum making its complete emptying possible. The valve 11 being at rest, valve 37 is actuated which places the outlet of the main filter 33 in hydraulic communication with the inlet of the cartridge 12. When the pressure pump 30 is set in operation the content of the reservoir 50 is repelled into the cartridge.

As will already have been understood, the architecture of the ink circuit presented here makes it possible to overcome the use of closing or self-closing connections which are costly.

As seen above, strong demand is placed on 2 of the 4 pumps which are in permanent operation as soon as the machine is used for printing: these are pump 30 called the <<pressure>> and pump 40 called the recovery pump. It is these pumps which will have the shortest lifetime. Also the main filter 33 gradually becomes clogged during the functioning of the machine until it needs to be replaced by a new filter.

A maintenance module (or component) 70 has therefore been designed comprising a casing which contains the pressure pump 30, the recovery pump 40 and the main filter 33. Preferably the filter is sized to have a lifetime comparable to that of the pumps. On this account a given lifetime can be assigned to the maintenance module itself. In practice, a user of the printer may replace a maintenance module e.g. as a preventive measure after each time lapse corresponding to the standard lifetime of the module. This module 70 is illustrated and described herein as having a casing. However it may also be a plate or board such as plate 73 to which the pressure pump 30, the recovery pump 40 and the main filter 33 are connected without any other side walls. As a further variant, the plate 73 is associated with flexible walls, the assembly therefore being closed but only the wall 73 is solid. The embodiment with a closed casing is advantageous since the casing acts as mechanical protection for the components contained therein. It is this embodiment which is described below but the other embodiments can easily be inferred therefrom, in particular since the plate 73 remains substantially the same for each thereof.

The first pump, the second pump and the filter are disposed on a same side of plate 73.

The maintenance module has a compact connection interface with the remainder of the ink circuit. This interface connects the inlets and outlets $\mathbf{71}_1$-$\mathbf{71}_6$ of the 3 elements grouped together in the module, to the inlets and outlets of the remainder of the ink circuit. This interface is advantageously formed in the plate or board 73 from which the inlet and outlets $71_1$-$71_6$ therefore emerge. This interface is advantageously formed in a plane of said plate or board 73.

Finally the module 70 also contains the fluid connection means between each of the elements it contains (the pressure pump 30, the recovery pump 40 and the main filter 33) and the inlet and outlet associated with this element. These fluid connection means correspond to the conduits 301, 302, 331, 332, 401, 402 in FIG. 8.

One problem which is then raised is the replacement of this maintenance module quickly and cleanly with no risk of ink flow during the operation. A certain number of constraints are to be taken into account (as mentioned above):

- the pressure pump 30 is advantageously kept in load, during functioning thereof to avoid air entering the pressure circuit. The pump is statically fed with ink.
- for cost-related reasons it is sought to obtain a very simple module connection system, in particular without self-closing connectors.

Figure 9:
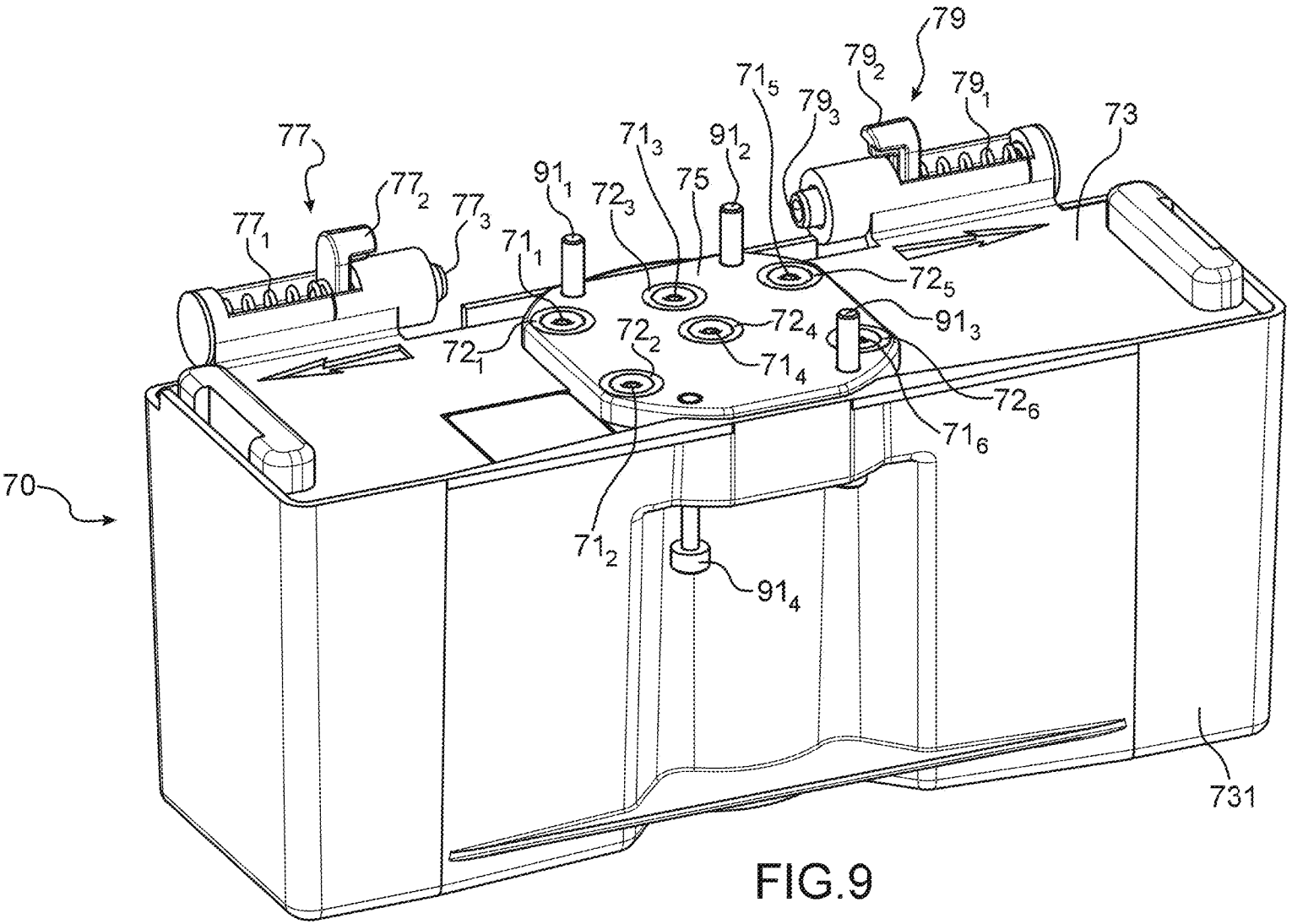
FIG. 9 is one embodiment of a removable component or module.

One example of embodiment of a said module is given in FIG. 9. It is in the form of a parallelepiped module which contains the pressurising pump 30, the recovery pump 40 and the main filter 33 and, as explained above, the lines which place them in fluid connection with the inlets and outlets of the remainder of the ink circuit.

In FIG. 9 the inlets and outlets can be seen of the 3 elements grouped together in the module which allow connection of the module to the remainder of the ink circuit:

- an inlet $71_1$ (or first inlet) for intake of ink into the pump 30;
- an outlet (or first outlet) $71_2$ for discharge of ink from the pump 30;
- an inlet $71_3$ (or second inlet) for intake of ink into the filter 33;
- an outlet $71_4$ (or second outlet) for discharge of ink from the filter 33;
- an inlet $71_5$ (or third inlet) for intake of fluid into the pump 40;
- an outlet $71_6$ (or third outlet) for discharge of the fluid from the pump 40, in the direction of the main reservoir.

Preferably these inlets and outlets are arranged on one same surface or plate 73 of the module. They may be grouped together on one same plate or board 75 so as to raise them relative to the surface 73, which facilitates their positioning opposite the inlets and outlets of the fixed part of the circuit. The first, second and third fluid inlets, and the first, second and third fluid outlets are disposed in a same plane of said plate.

The inlets $71_1$, $71_3$, $71_5$ cooperate with the corresponding outlets $73_1$, $73_3$, $73_5$ of the remainder of the fluid circuit. The outlets $71_2$, $71_4$, $71_6$ cooperate with the corresponding inlets $73_2$, $73_4$, $73_6$ of the remainder of the fluid circuit. These outlets $73_1$, $73_3$, $73_5$ and inlets $73_2$, $73_4$, $73_6$ can be seen in FIG. 10C. They are arranged so as to position an inlet or outlet of the module 70 opposite each thereof.

As will have been already understood it is therefore possible, between the maintenance module and the other components of the ink circuit, to do away with the use of closing or self-closing connections which are costly.

As can be seen in FIG. 9, each of the ends of the conduits intended to form a fluid connection can be equipped with an O-ring $72_1$-$72_6$ which, in functioning position, comes to lie against a concentric gasket surface having a corresponding opening on the fixed part. The inlets and outlets $73_1$-$73_6$ of this latter part have the same type of configuration as the inlets and outlet of the module 70, with conduit ends each of which has a concentric gasket surface.

The references $91_1$, $91_2$, $91_3$ and $91_4$ designate screws, for example captive screws, which allow the securing of the component onto the remainder of the ink circuit. Other securing solutions known to persons skilled in the art can be used.

One of the surfaces of the module, preferably the one on which the fluid inlets and outlets are arranged, further comprises means 77, 79 to allow mounting and dismounting of the module 70. These means may allow the defining of a hinge (or pivot pin) about which the module is able to pivot. They may be in the form of retractable pins returned by a spring 77, 79.

According to one embodiment, each thereof comprises a cylinder in which a spring $77_1$ and $79_1$ is able to slide under the action of bearing means $77_2$ and $79_2$, e.g. a lug that an operator can easily move with a finger between a locked position as in FIG. 9 and an unlocked position. At one end of each cylinder there is provided an opening through which a locking member $77_3$ and $79_3$ can easily enter and exit and thereby be placed in a locking position (as in FIG. 9) and an unlocked position (in which the locking member is at least partly engaged in the cylinder).

The two cylinders of the means 77, 79 are arranged aligned along an axis intended to be an axis of rotation, the locking members $77_3$ and $79_3$ coming to cooperate with corresponding members on the remainder of the machine. Conversely, it is the remainder of the machine which may comprise one or more locking members of this type, the module being equipped with corresponding means to cooperate with this or these members, the assembly forming means to allow the mounting and dismounting of the module.

As will be seen below, advantageously the inlet orifices $71_1$, $71_3$, $71_5$ are arranged in a position closer to this rotational axis than the outlet orifices $71_2$, $71_4$, $71_6$.

Electrical connection wires (not illustrated in the Figures) to bring the supply voltages to the pumps (pressure pump, recovery pump) can emerge from the casing for connection thereof, when the module is mounted, to printer powering means 3. These wires may for example be connected to a connector (not illustrated in the Figures) of the printer.

One embodiment of a device for mounting a module such as described above is illustrated in FIGS. 10A-10B.

It comprises two plates or boards 81, 83, which do not lie in the same plane (for example they are perpendicular to each other).

The components of the ink circuit are distributed over these two plates.

One (plate 81) supports at least one component (in practice: the maintenance module 70) that can easily and cleanly be replaced. The other (plate 83) supports the parts of the circuit retaining large volumes of fluid, in particular the reservoir 50 and the anti-pulse 80. The other components can advantageously be positioned at the rear of the plate 81 in the space delimited between this plate and plate 83. These components can also be dismounted without any risk of spillage when the plates are in maintenance position, as illustrated in FIG. 10B.

Advantageously the plates 81 and 83 are secured to one another, for example held at 90° to each other. A space delimited between them can also be delimited laterally by side plates or cheeks 831, 832.

The module 70 is held in position by its means 77, 79 along one edge of the plate 81. This edge is itself provided with means corresponding to these means 77, 79, intended to cooperate therewith. These may be two cylindrical tubes 77', 79' for example (that can be seen in FIG. 10D), arranged aligned and each provided with an opening at one of its ends arranged towards the outside of the device so as to cooperate with the locking members $77_3$ and $79_3$.

Reference 731 designates one face of the device, substantially perpendicular to the plate 73, but having an intersection therewith along an edge opposite the edge on which the means 77, 79 are arranged, in other words opposite the hinge or pivot pin.

Preferably the plates have two functional locking positions such as illustrated in FIGS. 10A and 10B:

FIG. 10A: a so-called normal functioning position in which the circuit parts (and in particular the main reservoir) arranged on or associated with the plate 83 lie fully or at least in part above the module 70, or at least above the pressure pump, so that the module 70 is statically fed with fluid under gravity (when loaded) from the main reservoir; more precisely the expression <<above the module 70>> means above a plane P (FIG. 10A) perpendicular to a direction of free flow of a fluid or perpendicular to the direction of the gravitational field and which substantially coincides with the wall 731 (which lies facing upwards in normal functioning position). FIG. 10A shows the intersection p formed of this plane with one edge of the device;

FIG. 10B: this shows another position so-called maintenance position, in which the circuit parts arranged on or associated with the plate 83 lie underneath the module 70 so that this module can be dismounted without any risk of fluid flowing from the module 70. More precisely, the expression <<underneath the module 70>> means underneath any part of the module 70, and in particular underneath a plane P' which substantially coincides with the plate 81.

Figure 10C:
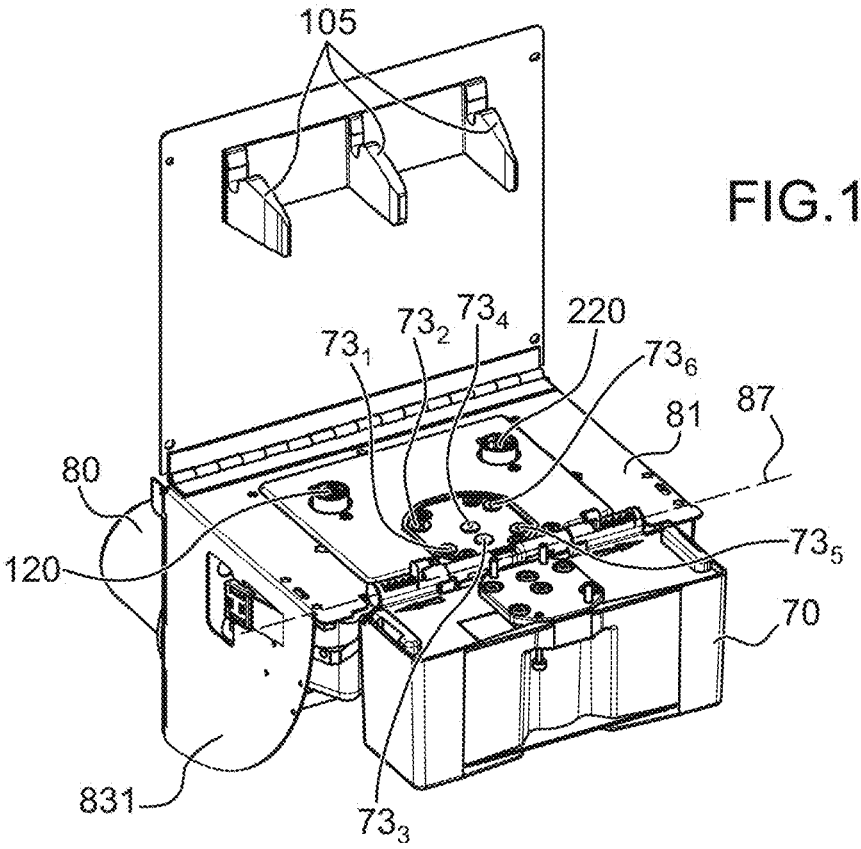
Figure 10D:
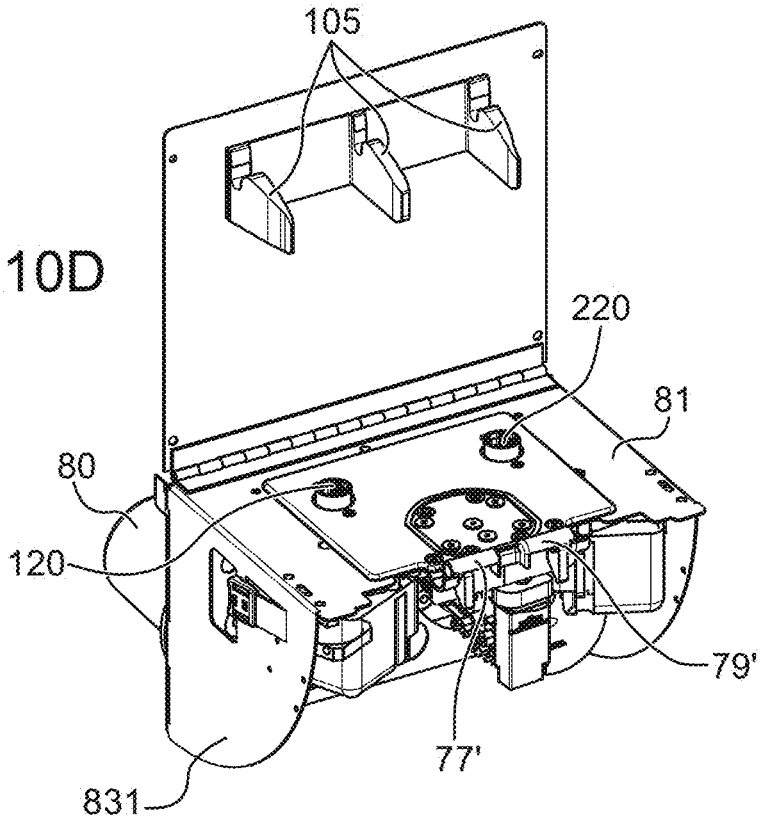
Figure 12B:
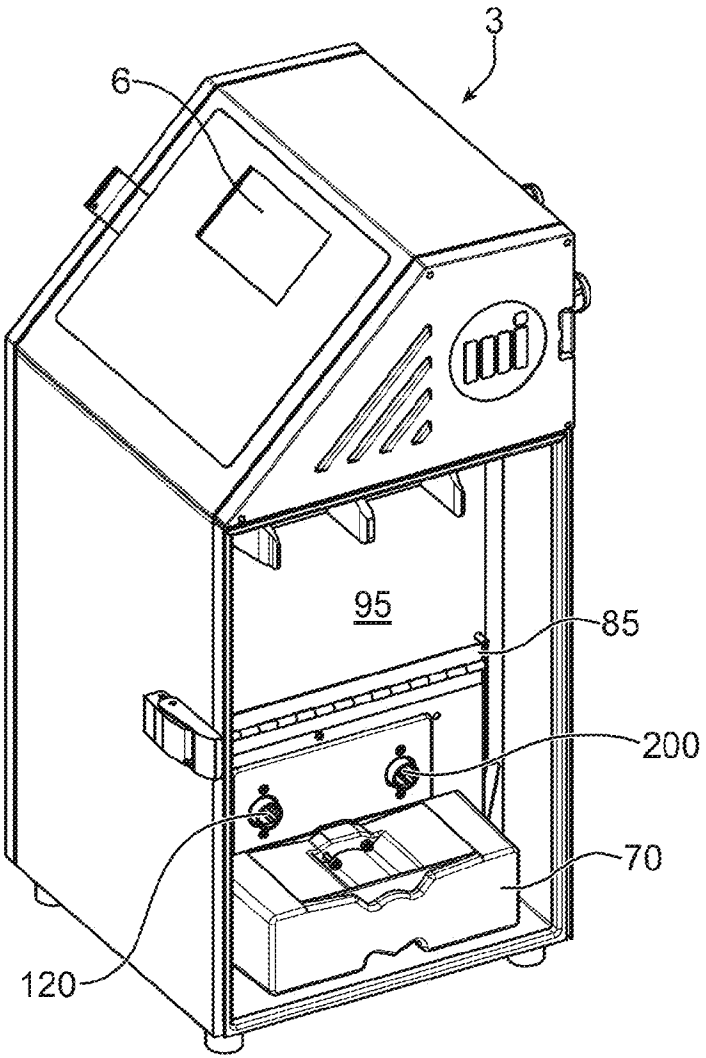
FIGS. 12A-12E illustrate dismounting steps of a removable component or module.
Figure 12A:
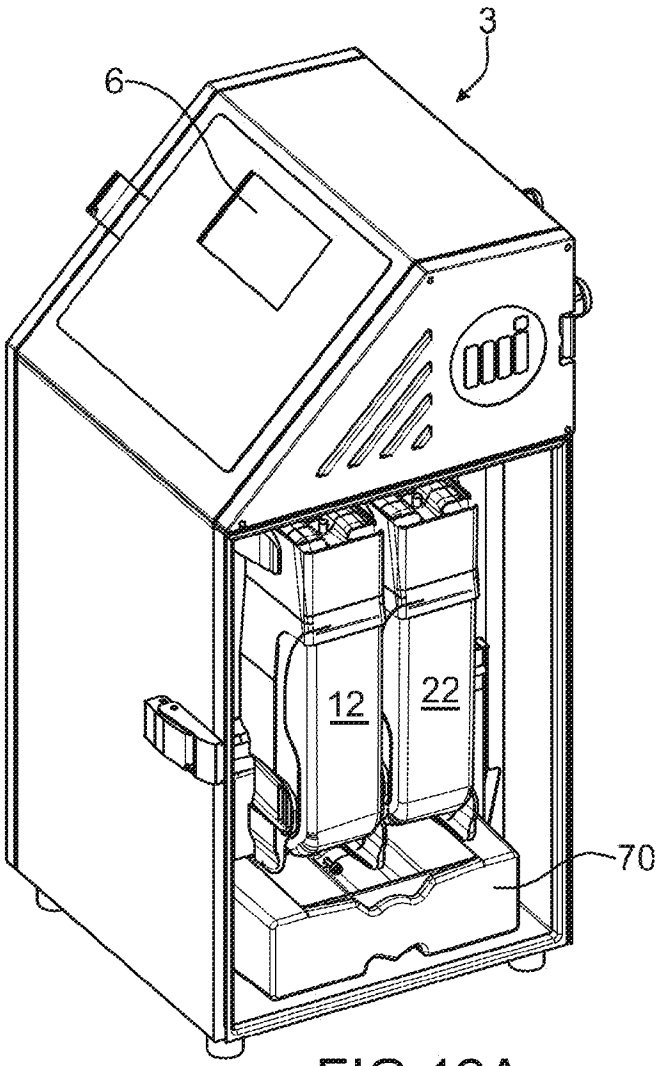
Figure 12D:
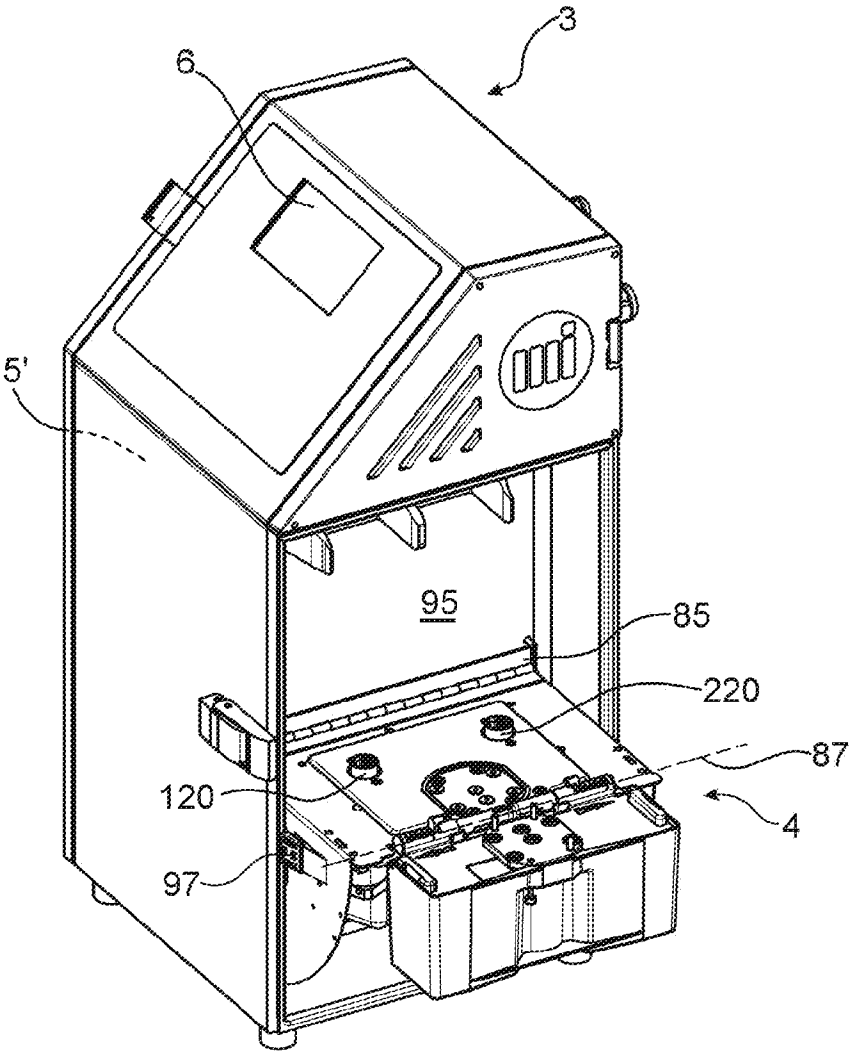
Figure 12C:
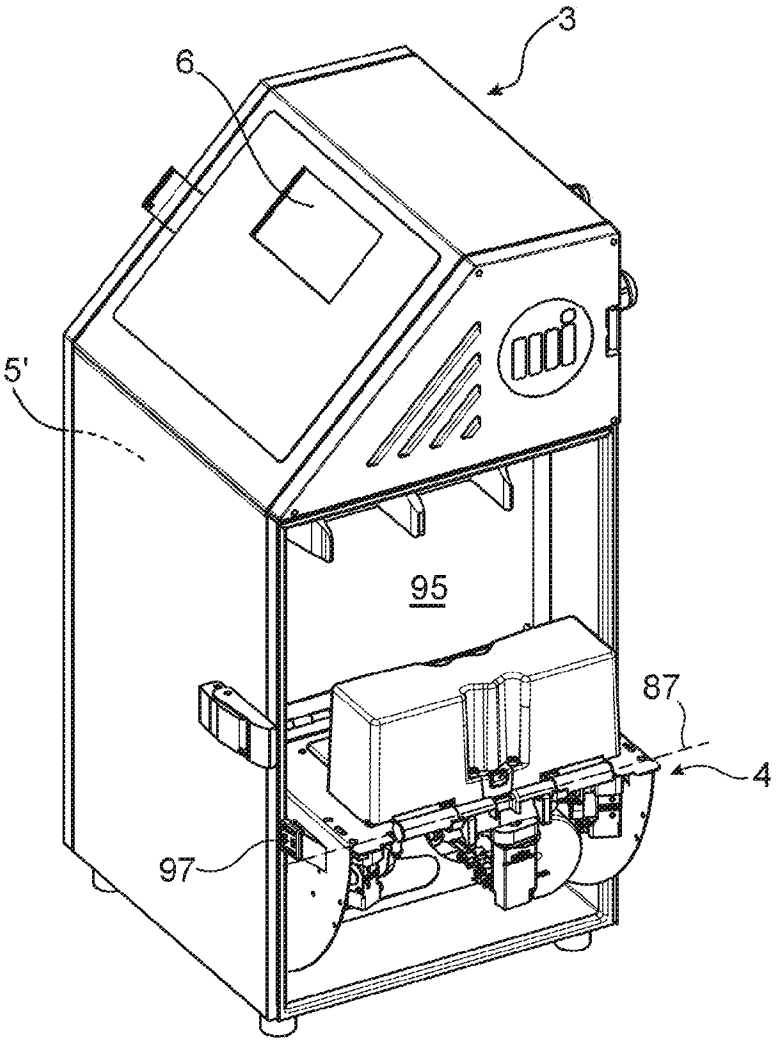
Figure 12E:
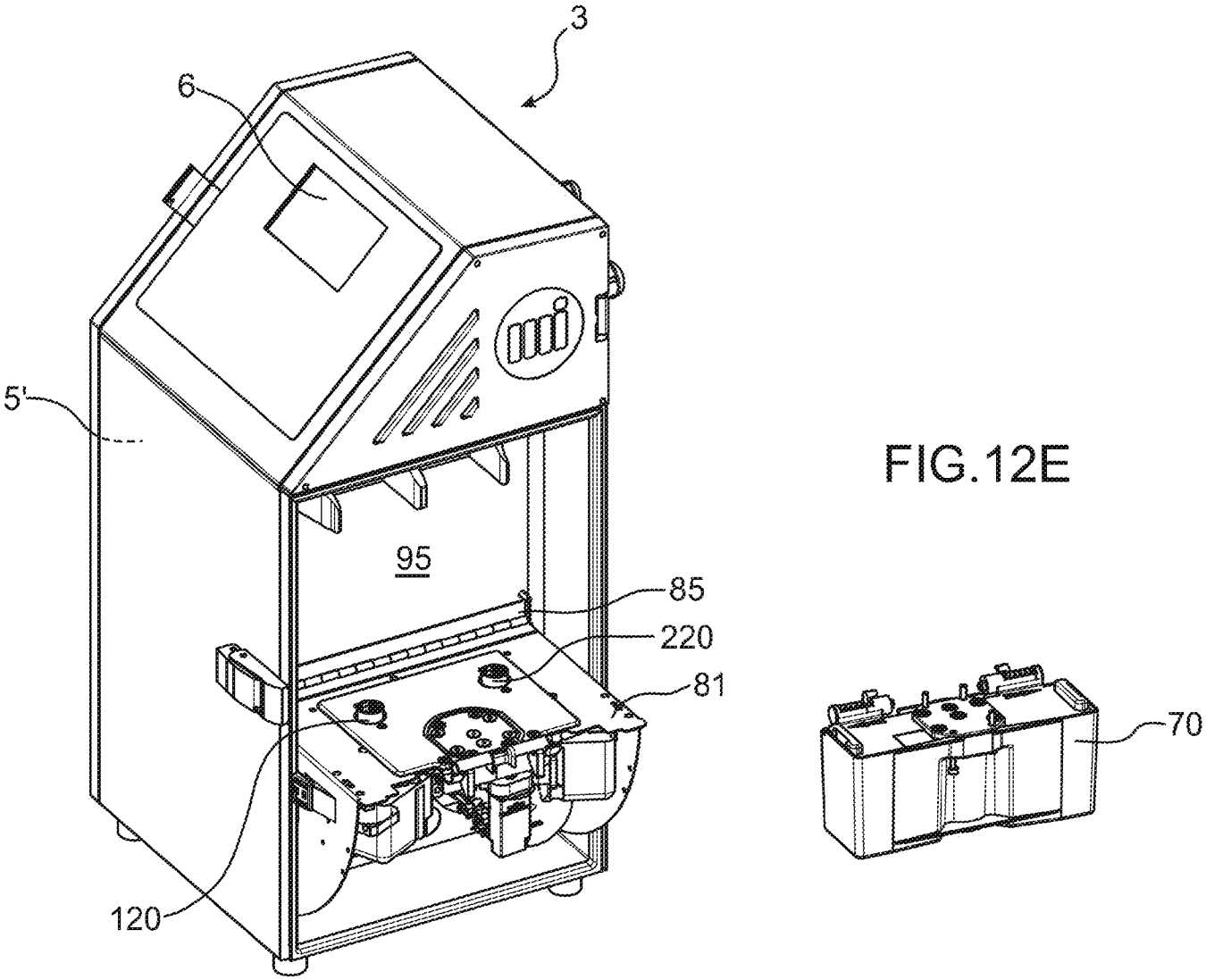

It is possible to lock the assembly in each of these positions via locking means, for example one or more side tongues 97 forming a spring which come to cooperate with one and/or the other of the two vertical uprights of the printer body which surrounds the access opening to the ink circuit as can be seen in FIG. 12C. These means can be arranged on one and/or the other of the side plates or cheeks 831, 832. The changeover from one position to the other is obtained by rotating the plates 81, 83 about a pivot pin 85. In normal functioning position (FIG. 10A) the plate 83 is horizontal and plate 81 is vertical. In maintenance position (FIG. 10B), the plate 83 is vertical and the plate 81 is horizontal. FIGS. 10B-10D give detailed illustrations of various maintenance steps, the plates 81, 83 therefore remaining in the position shown FIG. 10B.

The two plates 81, 83 are preferably secured together along a common axis of rotation 85. They may therefore jointly change over from one position called the normal functioning position to the other so-called maintenance position.

It can also be seen that the assembly of the two plates 81, 83 is attached to a plate 95 which is secured onto the body 3 of the printer (as can be seen in FIGS. 12A-12E). A lower edge of this plate allows the defining of the axis of rotation 85. This plate 95 can be provided with means 105 for positioning and holding the cartridges 12, 22 in place.

In maintenance position (FIG. 10B), the inlets and outlets $71_1$-$71_6$ of the exchangeable component 70, grouped together at the connection interface, lie substantially in one same horizontal plane. The fixed part of the connection interface is on the plate 81 and is then arranged underneath the component 70.

In this position, before dismounting, the component is able to be drained under gravity into the elements arranged on or associated with the plate 83, and in particular towards the main reservoir 50. Also the sealing of the connections between the two parts of the interface is achieved by means of individual O-rings for each inlet and outlet as already described above.

On dismounting, the inlets and outlets of the component 70 are first oriented downwards (FIG. 10B), and any fluid still contained in the component 70 is therefore able to flow towards the elements arranged on or associated with the plate 83, and in particular towards the main reservoir 50 and the anti-pulse 80; this is particularly the case for the main filter 33 which has a large retention volume. For maximum prevention of this type of flow, the separating movement (tilting) between the component 70 and the fixed connection interface is guided in rotation about the pin or axis 87 (on the changeover from FIG. 10B to FIG. 10C) defined by the means 77, 79, lying substantially in the plane of the interface. This pin or the axis is offset on the edge of the interface, more specifically on the edge of the plate 81.

The interface is designed so that the inlet orifices of the component are closer to the pin 87 than the outlet orifices. Therefore, when separating the two parts of the interface and, on account of the gradual relaxing of the compressed seals, an air intake is formed at the inlet orifices before the outlet orifices are opened. The inventors have ascertained that under these conditions and under the action of the surface tensions retaining the fluids against the walls of the cavities, no or only little residual flow of fluid occurs from the main filter 33.

The component 70 is then rotated about the pivot pin 87, preferably by about 180°.

On completion of this rotation (FIG. 10C), the connection interface of the maintenance module comes to lie face upwards and there is no longer any risk of residual fluid flow. The module can then be separated from the pivot pin 87 (FIG. 10D) and placed in a sealed container (bag) for evacuation.

The installing of a new module is carried out in reverse order: the new module 70 is initially positioned with its connection interface facing upwards. It is secured to the pin 87, and then tilted from its initial position so that the two parts of the interface come to be positioned facing one another, and it is then immobilised by the securing system 91 (screw, fastener, . . . ). Finally the plates 81 and 83 are tilted towards the normal functioning position, which re-places at least the pressure pump 30 in flooded suction or in a loaded state. The printer is again ready for operation.

As will be appreciated from the above, the exchange of the maintenance module is made quickly and cleanly without any specific tooling. It can be carried out by an operator not having any dedicated training and does not require the prior draining of reservoirs, conduits, pumps or filters.

The views in FIGS. 10A-10B are views from one same side, the side of the module 70.

Figure 11:
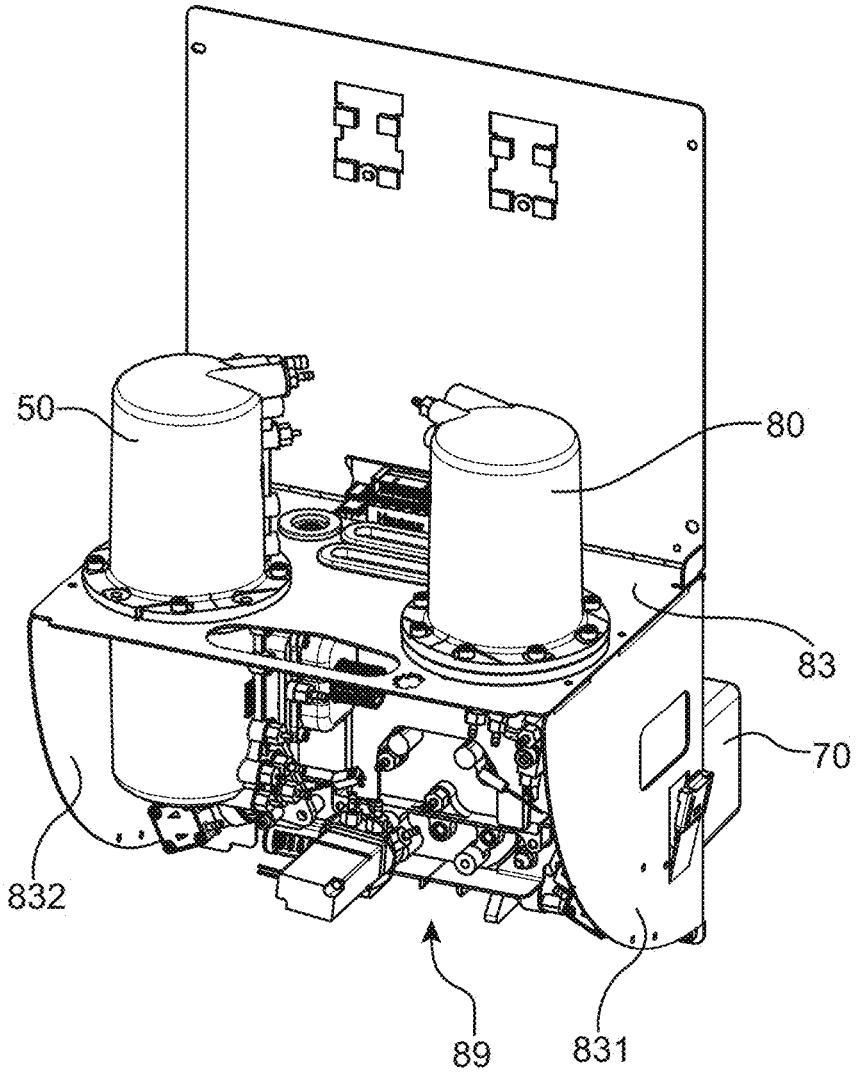
FIG. 11 gives a rear view of a fluid circuit embodiment.

FIG. 11 gives a view of the same device from the side opposite the module 70. On the plate 83, the securing can therefore be seen firstly of the main reservoir 50 and secondly of the anti-pulse device 80. Advantageously, these two parts are covered by a lid which is identical.

In the space between the two plates 83, 81 the other means of the fluid circuit can be arranged, in particular the pumps 10, 20, the cavity 23, the filters and the valves 11, 21, 32, 37.

In each of these Figures the means 105 can be seen which allow the positioning and holding in place of the ink and solvent cartridges 12, 22. These are illustrated in FIG. 12A in operating position above the module 70. The bottom part of these cartridges communicates via orifices 120, 220 (see FIG. 10A) with the fluid circuit. During an exchange operation of the module 70, first these two cartridges 12, 22 are removed, then the operations are performed that are described above with reference to FIGS. 10A-10D.

FIGS. 12A-12E illustrate the body 3 of the printer, which comprises the elements already described above with reference to FIG. 1. In particular, in the lower part there can be seen the ink circuit 4, of the type described above with reference to the preceding figures.

FIG. 12A illustrates the body of the printer of which one side panel has been removed: the cartridges 12, 22 can therefore be seen and the module 70 in operating position.

To remove this module 70 first the cartridges 12, 22 are removed, this is the stage illustrated in FIG. 12B. As explained above with reference to FIG. 10B, the assembly of plates 81, 83 is then rotated to bring the module 70 to the top position (FIG. 12C). This tilting assembly 81, 83 is immobilized by action of the locking means 97 already described above. Next, the module 70 undergoes a rotation about the pin 87: this is the stage illustrated in FIG. 12D. It is then possible to remove the module 70 and optionally to replace it with a new module.

One aspect of the invention therefore also concerns a CIJ printer body 3 provided with an ink circuit, whose components are arranged on three plates, one fixed plate 95 and two plates 81, 83 mobile in rotation each relative to a horizontal axis defined on the fixed plate. The axis of rotation of each plate is substantiated by a hinge 85.

One of the mobile plates 81 is able to receive a maintenance module 70 that can easily be separated from its base itself fixed onto the plate 81. The other mobile plate 83 particularly supports the main reservoir 50 and the anti-pulse 80 which are hydraulically connected to the maintenance module. The other components can advantageously be placed at the rear of the plate 81 in the space delimited between this plate and plate 83. These components can also be dismounted without any risk of spillage when the plates are in maintenance position as illustrated in FIG. 10B.

The three plates and the hinges are arranged so that two operational configurations are possible, described above with reference to FIGS. 10A and 10B.

A description has been given on how to obtain an ink circuit doing away with usual costly fluid components, which allows the cost of the ink circuit to be reduced whilst maintaining acceptable performance and reliability.

It is thereby possible to meet the need for a printer that is simplified from a technical viewpoint, and hence low-cost, whilst ensuring user satisfaction in terms of performance levels of basic functionalities and machine reliability.

The hydraulic circuit presented herein is simple: it minimizes the number of components, and simplifies the assembly of the ink circuit.

When using a machine of this type, a user is able to minimize risks concerning the availability factor of the machine following from the need for curative maintenance, by setting up of preventive maintenance operations that are automated or planned and have no significant impact on cost. It is recalled that:

the objective of automatic preventive maintenance operations is to guarantee the functional integrity of the components at every operating phase of the machine. In particular they allow clogging of pumps and solenoid valves to be avoided and the fouling or the obstruction of lines when the ink has dried;

planned maintenance operations consist for example of exchanging those components having a limited lifetime under optimal conditions of servicing time and cleanliness.

The invention can be applied to a printer such as described above with reference to FIG. 1. This particularly comprises a print head 1, in general offset from the body of the printer 3, and connected thereto by means e.g. in the form of a flexible umbilical cable 2 grouping together the hydraulic and electrical connections allowing functioning of the head.

Mention was made above of means forming a controller or control means. These means comprise a microcomputer for example or a microprocessor which transmits printing instructions to the head but also drives the motors and valves of the system to manage feeding of ink and/or solvent to the circuit and recovery of the ink-air mixture from the head. They are therefore programmed for this purpose. These controller-forming means or these control means are arranged in part 5' of the system or printer body.

In the various embodiments, and in particular on FIGS. 4A, 4B, 7A, 7B, 8, 9-12E, conduits or pipes connect the different elements (pumps, filters . . . etc) together.

The invention claimed is:

1. A pumping circuit for fluid of an ink circuit in a continuous inkjet printer, comprising a diaphragm pump, an inlet circuit comprising an inlet conduit into said pump for the fluid to be pumped, and an outlet conduit for the fluid pumped by said pump, said pumping circuit comprising:

a back-flow line which removes, from an outlet of said pump, part of the pumped fluid and returns it to the inlet circuit of fluid to be pumped; and at least one singular restriction having a length less than its diameter so as to create a pressure drop insensitive to a viscosity of the fluid passing through it, being arranged on a path of the fluid in the back-flow line, said back-flow line regulating the pressure and the flow rate of the fluid at an outlet of said pump.

2. The pumping circuit according to claim 1, wherein the back-flow line returns part of said pumped fluid towards said inlet conduit.

3. The pumping circuit according to claim 2, wherein the fluid is a solvent, said inlet circuit being adapted to contain a cartridge to contain said solvent.

4. The pumping circuit according to claim 2, further comprising means to reduce pressure fluctuations due to the functioning of the diaphragm pump.

5. The pumping circuit according to claim 2, further comprising a cavity arranged downstream of the pump and upstream of said back-flow line, and configured to contain a volume of a solvent and to reduce pressure fluctuations due to functioning of the diaphragm pump.

6. The pumping circuit according to claim 5, wherein an outlet conduit of the fluid pumped by said pump leads into a lower part of the cavity, and wherein a conduit connected to the back-flow line leads into a portion located above said lower part.

7. The pumping circuit according to claim 5, wherein the cavity comprises an outlet extending towards an outlet conduit for the fluid.

8. The pumping circuit according to claim 2, further comprising a valve whose position allows fluid to be brought towards the back-flow line.

9. The pumping circuit according to claim 1, further comprising a viscous leak, or means to create a pressure drop by friction loss, in series with said at least one singular restriction in said back-flow line.

10. The pumping circuit according to claim 9, wherein said circuit is able to comprise a reservoir to contain said fluid, wherein an inlet conduit of the pump inlets fluid from said reservoir, and wherein the back-flow line returns part of said pumped fluid towards said reservoir.

11. The pumping circuit according to claim 10, further comprising a detector for measuring a filling level of the reservoir.

12. The pumping circuit according to claim 9, wherein the fluid is a mixture of solvent and ink.

13. The pumping circuit according to claim 9, further comprising a filter for filtering the fluid pumped by the diaphragm pump.

14. The pumping circuit according to claim 9, further comprising a system to reduce pressure fluctuations due to functioning of said pump.

15. The pumping circuit according to claim 9, further comprising at least two bellows hydraulically connected by a hydraulic pressure drop connection to reduce pressure fluctuations due to functioning of said pump.

16. The pumping circuit according to claim 9, further comprising a sensor to measure a pressure of said fluid downstream of said pump.

17. The pumping circuit according to claim 16, wherein said sensor further allows measurement of the temperature of said fluid.

18. The pumping circuit according to claim 9, further comprising a valve whose position allows fluid to be brought to the back-flow line.

* * * * *